US010160238B2

(12) United States Patent
Matsunaga et al.

(10) Patent No.: US 10,160,238 B2
(45) Date of Patent: Dec. 25, 2018

(54) IMAGE FORMING APPARATUS

(71) Applicant: FUJI XEROX CO., LTD., Tokyo (JP)

(72) Inventors: Takeshi Matsunaga, Kanagawa (JP); Chikara Manabe, Kanagawa (JP); Yuichi Inoue, Kanagawa (JP); Kazuyuki Hara, Kanagawa (JP); Masaki Kataoka, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 15/398,858

(22) Filed: Jan. 5, 2017

(65) Prior Publication Data

US 2018/0001679 A1 Jan. 4, 2018

(30) Foreign Application Priority Data

Jun. 30, 2016 (JP) ..... 2016-130666

(51) Int. Cl.
*B41J 15/16* (2006.01)
*B65H 9/00* (2006.01)
(Continued)

(52) U.S. Cl.
CPC ..... *B41J 15/16* (2013.01); *B41J 13/32* (2013.01); *B65H 9/002* (2013.01);
(Continued)

(58) Field of Classification Search
CPC ..... B65H 2220/02; B65H 2404/14; B65H 2404/14212; B65H 2301/331; B65H 9/166; B65H 23/032; G03G 15/6567
See application file for complete search history.

(56) References Cited

U.S. PATENT DOCUMENTS 5,662,321 A * 9/1997 Borostyan ..... B65H 7/08 271/10.03
5,697,608 A * 12/1997 Castelli ..... B65H 9/002 271/228

(Continued)

FOREIGN PATENT DOCUMENTS

| | | |
|---|---|---|
| JP | 2008-062432 | 3/2008 |
| JP | 2010-195566 | 9/2010 |
| JP | 2015-093756 | 5/2015 |

OTHER PUBLICATIONS

Abstract and machine translation of JP 2015-093756.
Abstract and machine translation of JP 2008-062432.
Abstract and machine translation of JP 2010-195566.

*Primary Examiner* — John P Zimmermann
(74) *Attorney, Agent, or Firm* — Fildes & Outland, P.C.

(57) ABSTRACT

An image forming apparatus includes: a plurality of droplets ejecting members that are opposed to a continuous sheet being conveyed, are arranged in a sheet conveying direction, and eject droplets onto the continuous sheet; movement restriction members that restrict movement, in a sheet width direction, of one end portion, in the sheet width direction, of a portion, opposed to the droplets ejecting members, of the continuous sheet; and tension application members that give tension in the sheet width direction to the portion, opposed to the droplets ejecting members, of the continuous sheet in a state that movement, in the sheet width direction, of the portion, opposed to the droplets ejecting members, of the continuous sheet is restricted by the movement restriction members.

1 Claim, 33 Drawing Sheets

(51) Int. Cl.
*G03G 15/00* (2006.01)
*B41J 13/32* (2006.01)

(52) U.S. Cl.
CPC .... *B65H 2220/02* (2013.01); *B65H 2511/242* (2013.01); *B65H 2701/1315* (2013.01); *G03G 15/6567* (2013.01); *G03G 2215/00561* (2013.01)

(56) References Cited

U.S. PATENT DOCUMENTS

| | | | | |
|---|---|---|---|---|
| 6,053,494 | A * | 4/2000 | Baskette | B65H 29/60 271/251 |
| 8,074,982 | B2 * | 12/2011 | Tharayil | B65H 7/10 271/228 |
| 8,474,818 | B2 * | 7/2013 | deJong | B65H 5/062 271/273 |
| 8,699,936 | B2 * | 4/2014 | Fujita | G03G 15/6567 271/225 |
| 8,910,936 | B2 * | 12/2014 | Tsou | B65G 47/24 198/395 |
| 2003/0126962 | A1 * | 7/2003 | Bland | B41J 11/46 83/13 |
| 2005/0002718 | A1 * | 1/2005 | Winter | B65H 23/0204 400/579 |

* cited by examiner 10
40
50
52
54
54A
54B
54C
60
62
64
64A
64B
64C
70
72
80
82
84
22
P
H
W
D

IMAGE FORMING APPARATUS

CROSS-REFERENCE TO RELATED APPLICATIONS

This application is based on and claims priority under 35 USC 119 from Japanese Patent Application No. 2016-130666 filed on Jun. 30, 2016.

BACKGROUND

Technical Field

The present invention relates to an image forming apparatus.

SUMMARY

According to an aspect of the invention, there is provided an image forming apparatus comprising: plural droplets ejecting members that are opposed to a continuous sheet being conveyed, are arranged in a sheet conveying direction, and eject droplets onto the continuous sheet; movement restriction members that restrict movement, in a sheet width direction, of one end portion, in the sheet width direction, of a portion, opposed to the droplets ejecting members, of the continuous sheet; and tension application members that give tension in the sheet width direction to the portion, opposed to the droplets ejecting members, of the continuous sheet in a state that movement, in the sheet width direction, of the portion, opposed to the droplets ejecting members, of the continuous sheet is restricted by the movement restriction members.

BRIEF DESCRIPTION OF THE DRAWINGS

Exemplary embodiments of the present invention will be described in detail based on the following figures, wherein.

DESCRIPTION OF SYMBOLS

Figure 1:
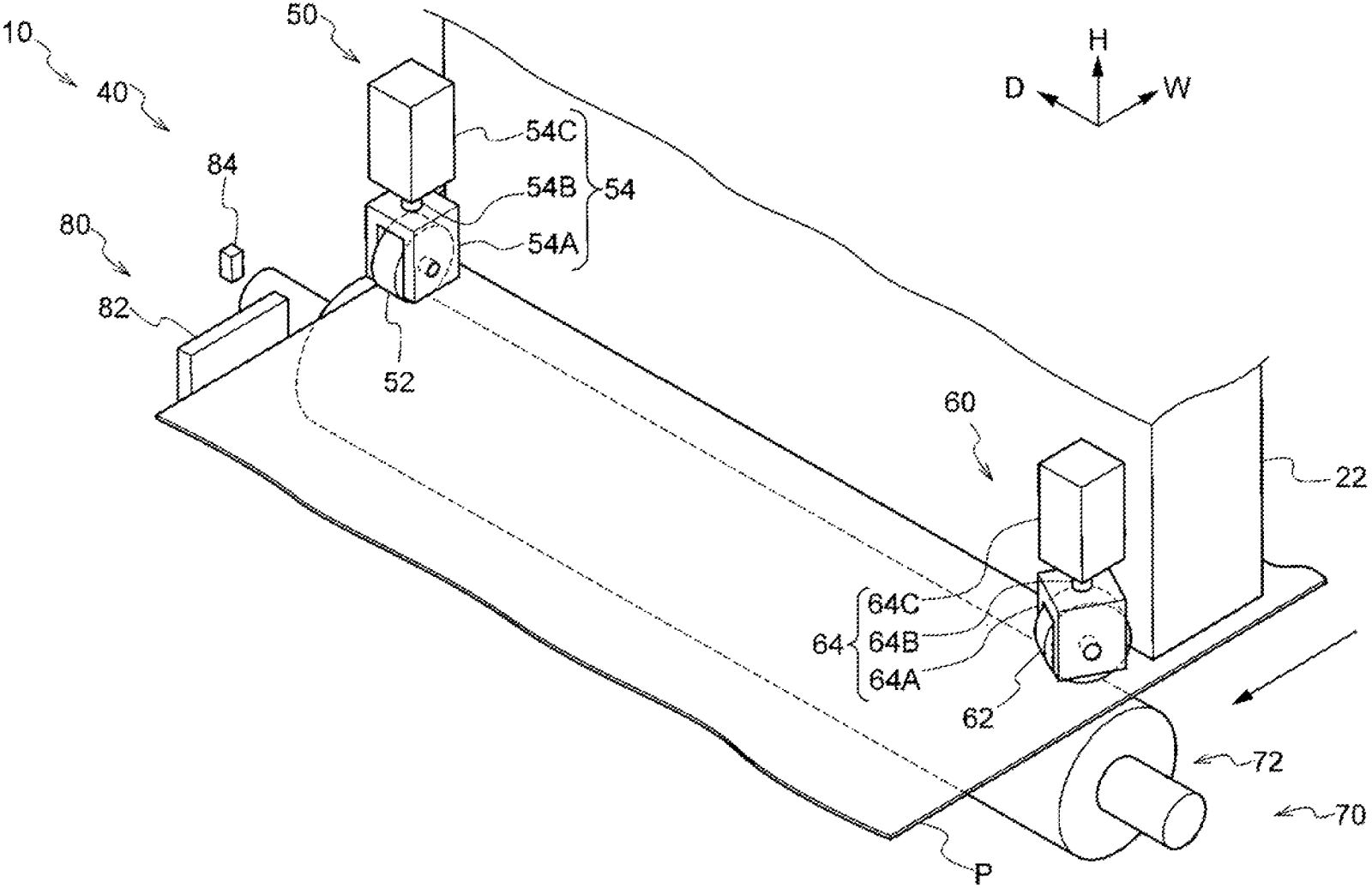
FIG. 1 is a perspective view of a restricting device of an image forming apparatus according to a first exemplary embodiment of the present invention.

10: Image forming apparatus
22: Droplets ejecting head (example droplets ejecting member)
22C: Droplets ejecting head (example droplets ejecting member)
22K: Droplets ejecting head (example droplets ejecting member)
22M: Droplets ejecting head (example droplets ejecting member)
22Y: Droplets ejecting head (example droplets ejecting member)
38: Control unit
52: Restriction roll (example movement restriction member)
54: Switching member (example first switching member)
62: Slant roll (example tension application member)
64: Switching member (example second switching member)
82: Guide plate (example restriction member)
100: Image forming apparatus
124: Suction pump (example first switching device)
126: Absorption region (example movement restriction member)
128: Control unit
150: Image forming apparatus
166: Slant roll (example tension application member)
168: Switching member (example second switching member)
178: Control unit
200: Image forming apparatus
216: Absorption region (example movement restriction member)
224: Suction pump (example first switching device)
228: Control unit
250: Image forming apparatus
266: Support roll (example movement restriction member)
278: Control unit
300: Image forming apparatus
312: Support roll (example rotary member)
350: Image forming apparatus
362: Support roll (example rotary member)
364: Suction pump (example first switching device)
366: Absorption region (example movement restriction member)
400: Image forming apparatus
412: Support roll (example tension application member)

DETAILED DESCRIPTION

Exemplary Embodiment 1

An image forming apparatus 10 according to a first exemplary embodiment of the present invention will be described below with reference to FIGS. 1-12. Arrows H, W, and D in the figures indicate the top-bottom direction (vertical direction) of the apparatus, a conveying direction of a recording medium (horizontal direction), and the width direction of the recording medium (horizontal direction), respectively.

(Overall Configuration)

Figure 9:
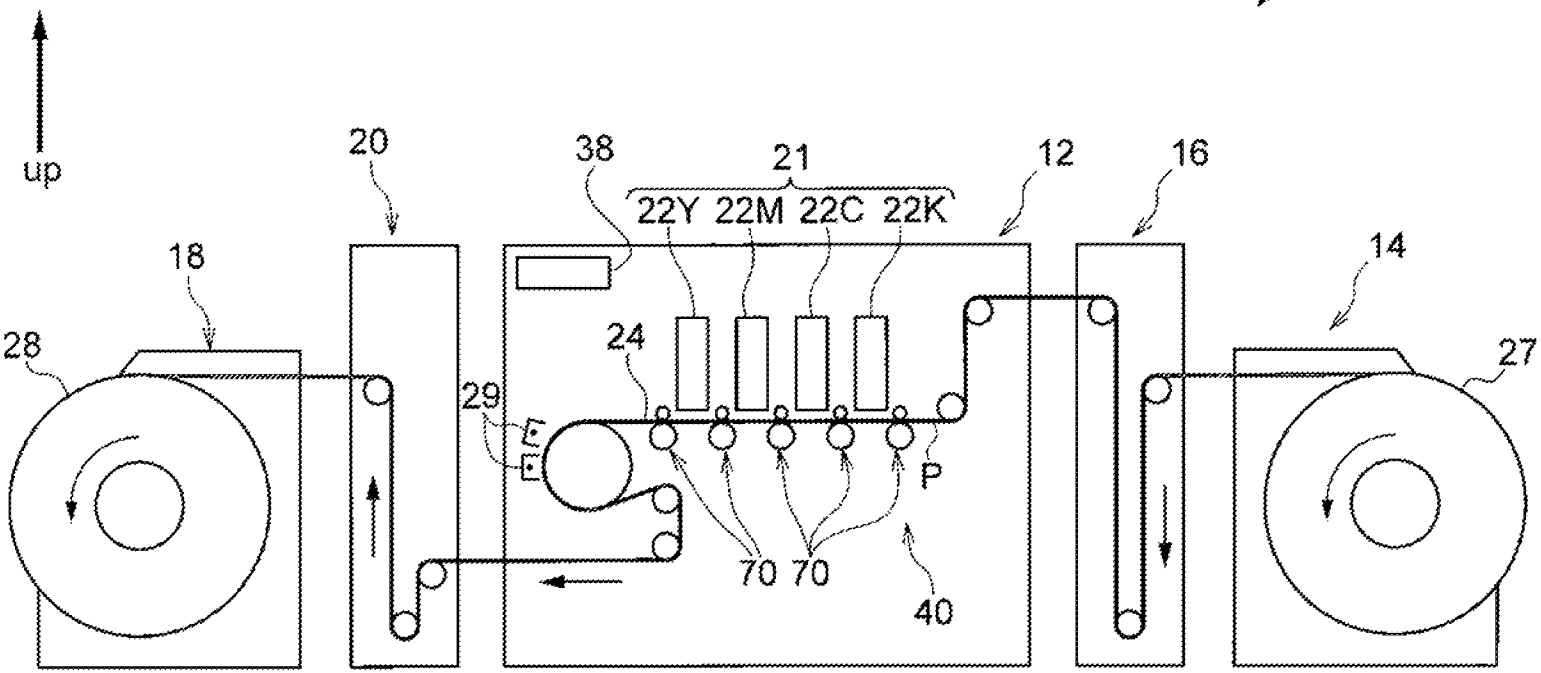
FIG. 9 shows the configuration of the image forming apparatus according to the first exemplary embodiment of the invention.

As shown in FIG. 9, the image forming apparatus 10 is equipped with an image forming unit 12 for forming an image on a portion of a continuous sheet P (recording medium), a preprocessing unit 14 which houses the continuous sheet P to be supplied to the image forming unit 12, and a buffer unit 16 which is disposed between the image forming unit 12 and the preprocessing unit 14 and adjusts the rate of conveyance of a portion, to be supplied from the preprocessing unit 14 to the image forming unit 12, of the continuous sheet P and other things.

The image forming apparatus 10 is equipped with a post-processing unit 18 which houses part of the continuous sheet P put out of the image forming unit 12 and a buffer unit 20 which is disposed between the image forming unit 12 and the post-processing unit 18 and adjusts the rate of conveyance of a portion, to be put out of the image forming unit 12 to the post-processing unit 18, of the continuous sheet P and other things.

A droplets ejecting device 21 for forming an image on a portion, being conveyed along a conveyance path 24, of the continuous sheet P by ejecting droplets onto it is disposed inside the image forming unit 12.

The droplets ejecting device 21 is equipped with a droplets ejecting head 22K which is an example droplets ejecting member for forming a K (black) image by ejecting droplets onto a portion of the continuous sheet P, a droplets ejecting head 22C which is an example droplets ejecting member for forming a C (cyan) image, a droplets ejecting head 22M which is an example droplets ejecting member for forming an M (magenta) image, and a droplets ejecting head 22Y which is an example droplets ejecting member for forming a Y (yellow) image.

The droplets ejecting heads 22K, 22C, 22M, and 22Y are arranged in this order downstream in the conveying direction of the continuous sheet P (hereinafter referred to simply as a "sheet conveying direction" so as to be opposed to a portion of the continuous sheet P. In the following description, characters K, Y, M, and C to be attached to reference numerals will be omitted if the colors K, Y, M, and C need not be discriminated from each other for components concerned.

Also disposed inside the image forming unit 12 are a restricting device 40 for restricting the conveyance of a portion, opposed to the droplets ejecting device 21, of the continuous sheet P, a halogen heater 29 for drying an image formed on the portion of the continuous sheet P, and a control unit 38 for control ling individual components. A control system of the control unit 38 is shown in a block diagram of FIG. 11. The restricting device 40 will be described later in detail.

The preprocessing unit 14 is equipped with a supply roll 27 which is wound with the continuous sheet P to be supplied to the image forming unit 12 and is supported rotatably by a frame member (not shown).

On the other hand, the post-processing unit 18 is equipped with a take-up roll 28 for taking up an image-formed portion of the continuous sheet P. The take-up roll 28 is rotated receiving rotational force from a motor (not shown), whereby tension is applied to the continuous sheet P in its conveying direction and a portion of the continuous sheet P is conveyed along the conveyance path 24.

In the above configuration, tension is applied to the continuous sheet P in the sheet conveying direction and a portion of the continuous sheet P is conveyed along the conveyance path 24 by rotating the take-up roll 28. The droplets ejecting heads 22 eject droplets of the respective colors in order onto the portion of the continuous sheet P being conveyed, whereby an image is formed on the portion of the continuous sheet P.

(Configuration of Essential Part)

Next, the restricting device 40 will be described.

As shown in FIG. 9, the restricting device 40 is disposed so as to restrict the conveyance of a portion, opposed to the droplets ejecting heads 22, of the continuous sheet P.

Figure 5:
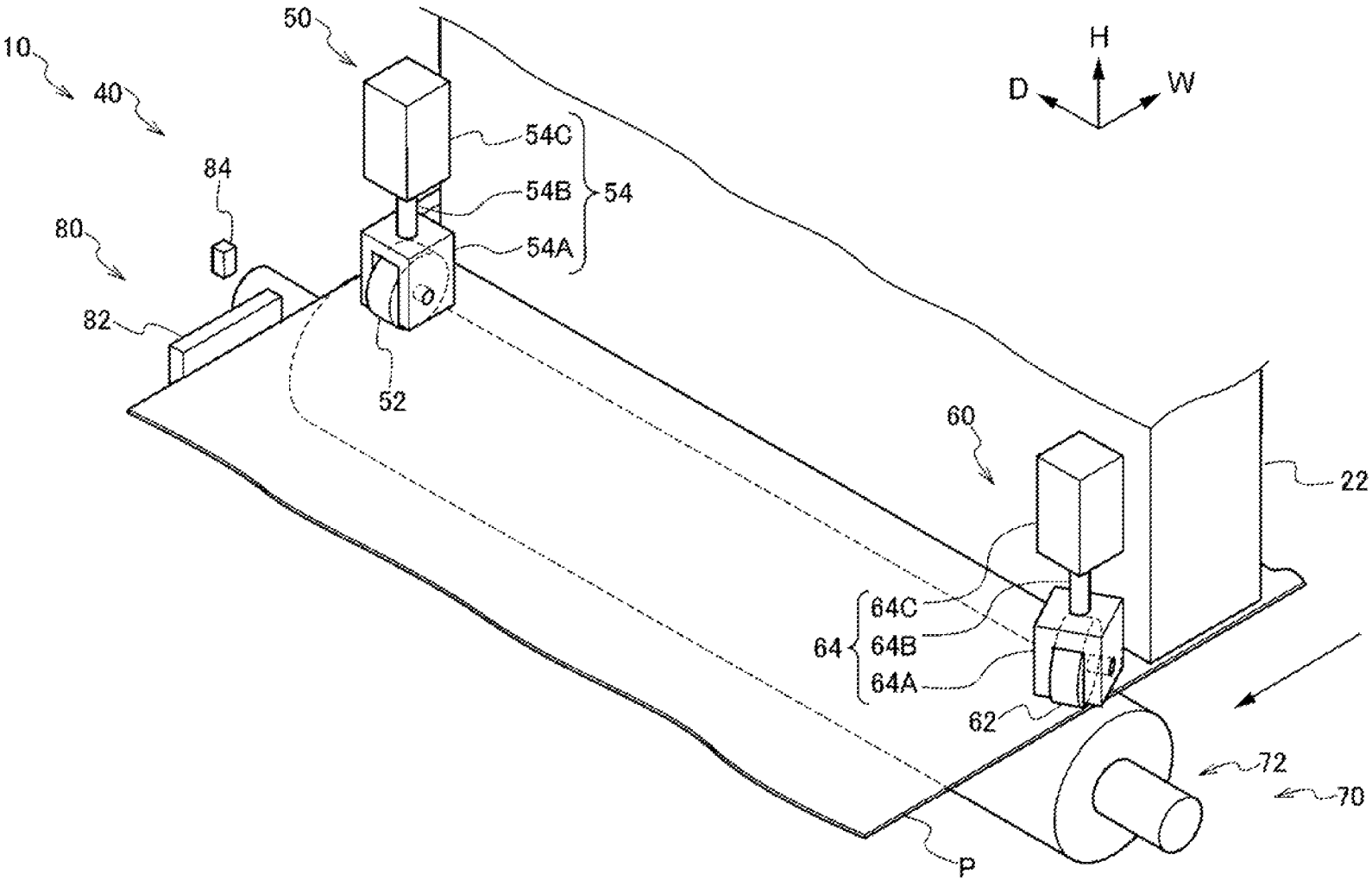
FIG. 5 is a further perspective view of the restricting device of the image forming apparatus according to the first exemplary embodiment of the invention.

As shown in FIGS. 5 and 9, the restricting device 40 is equipped with movement restricting mechanisms 50 which are disposed on the same side (hereinafter referred to as an "image formation side") of the above portion of the continuous sheet P as the droplets electing heads 22 and tension applying mechanisms 60. The restricting device 40 is also equipped with support mechanisms 70 which are disposed on the side (hereinafter referred to as a "non-image-formation side"), opposite to the droplets ejecting heads 22, of that portion of the continuous sheet P and guide mechanisms 80 which are disposed outside that portion of the continuous sheet P in its width direction.

[Support Mechanisms 70]

As shown in FIG. 9, the plural support mechanisms 70 are arranged in the sheet conveying direction so that a portion, opposed to each droplets ejecting head 22, of the continuous sheet P is supported by two support mechanisms 70 located upstream and downstream of that portion of the continuous sheet P.

As shown in FIG. 5, each support mechanism 70 is equipped with a support roll 72 which supports the continuous sheet P fully in its width direction. The support roll 72 is supported rotatably by the frame member (not shown).

In the above structure, the support roll 72 is in contact with the non-image-formation surface of the continuous sheet P and supports the continuous sheet P from below. And the support roll 72 rotates following the continuous sheet P being conveyed.

[Guide Mechanisms 80]

Figure 8:
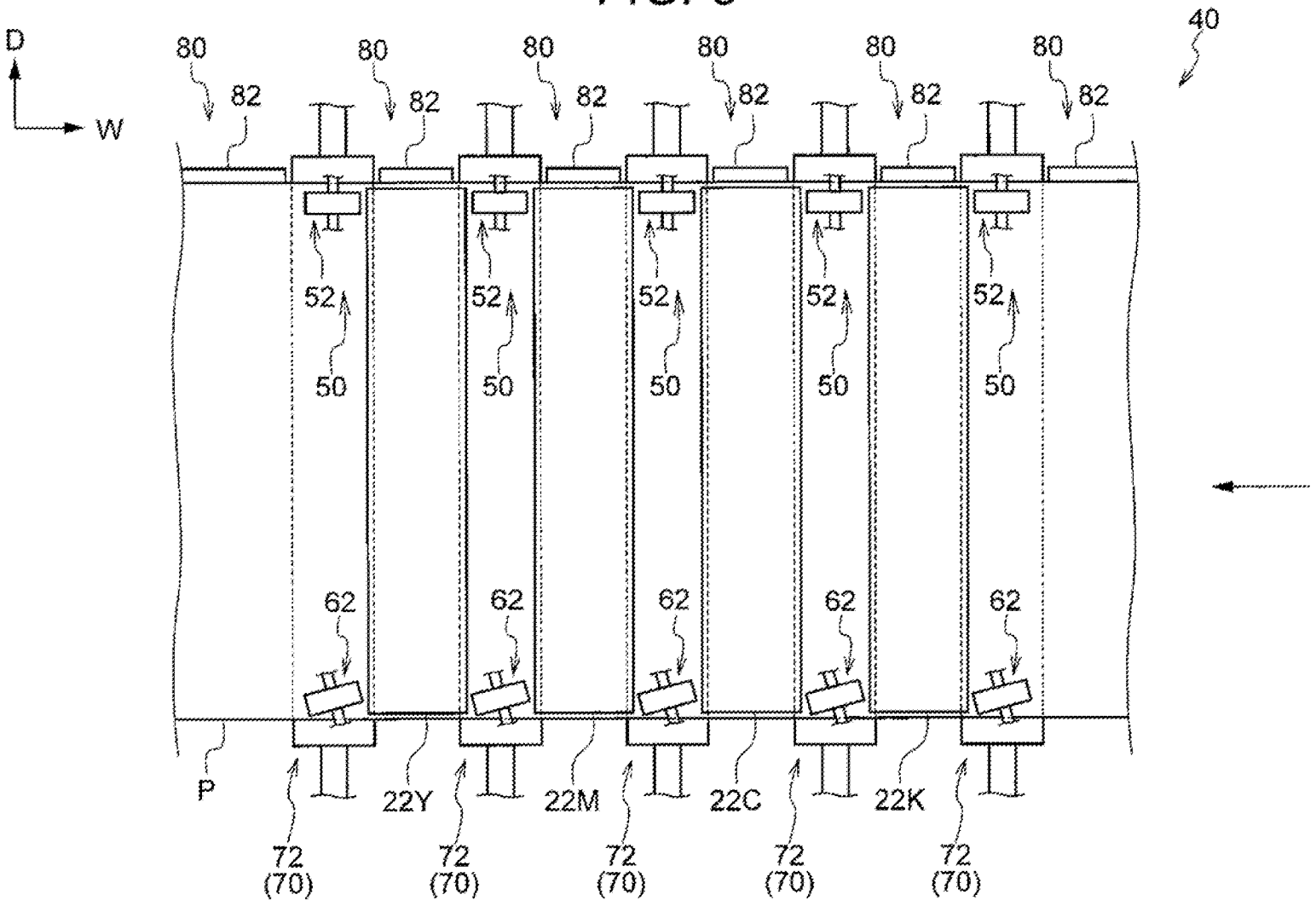
FIG. 8 is a further plan view of the restricting device of the image forming apparatus according to the first exemplary embodiment of the invention.

As shown in FIG. 8, adjoining ones of the plural guide mechanisms 80 which are disposed on the deep side of (in FIG. 8, above) the continuous sheet P in its width direction are located on the two respective sides of the associated support mechanism 70 in the sheet conveying direction. The guide mechanisms 80 serve to restrict the position of the continuous sheet P in its width direction.

As shown in FIG. 5, each guide mechanism 80 is equipped with a plate-like guide plate 82 which is an example restriction member and an optical sensor 84 (hereinafter referred to as a sensor 84). The plate surface of each guide mechanism 80 is perpendicular to the width direction of the continuous sheet P.

In the above structure, the guide plates 82 are in contact with one edge, in the width direction of the continuous sheet P, of a portion, opposed to the droplets ejecting heads 22, of the continuous sheet P and thereby restrict the position of the continuous sheet P in its width direction. Each sensor 84 serves to detect whether the one edge of that portion of the continuous sheet P is in contact with the associated guide plate 82. The control unit 38 receives detection results of the sensors 84 (see FIG. 11).

The positions of the guide plates 82 in the width direction of the continuous sheet P are set so that gaps are formed between the one edge of a portion, opposed to the droplets ejecting heads 22, of the continuous sheet P and the guide plates 82 when the continuous sheet P is conveyed in a state that no forces are applied to that portion of the continuous sheet P from the movement restricting mechanisms 50 or the tension applying mechanisms 60 (described below in detail).

[Movement Restricting Mechanisms 50]

As shown in FIGS. 5 and 8, the plural movement restricting mechanisms 50 are disposed on the deep side of the continuous sheet P in its width direction on the opposite side of a portion, opposed to the droplets ejecting heads 22, of the continuous sheet P to the support mechanisms 70. The movement restricting mechanisms 50 restrict movement of that portion of the continuous sheet P in its width direction.

As shown in FIG. 5, each movement, restricting mechanism 50 is equipped with a restriction roll 52 which is an example movement restriction member and a switching member 54 which is an example first switching member.

The restriction roll 52 is disposed in such a manner that its rotation plane (i.e., the plane that is perpendicular to its axis) is parallel with the sheet conveying direction.

The switching member 54 is equipped with a support portion 54A which supports the restriction roll 52 rotatably, a cylindrical rod 54B which extends upward from the support portion 54A, and a body portion 54C which moves the support portion 54A in the vertical direction via the rod 54B.

In the above structure, the control unit 38 (see FIG. 11) controls the switching member 54 to move the restriction roll 52 in the vertical direction between a movement restriction position (movement-restricted state) and a movement permission position (movement-permitted state). When the restriction roll 52 is moved to the movement restriction position, as shown in FIG. 5, an end portion (one end portion), located on the deep side in the width direction of the continuous sheet P, of the continuous sheet P is sandwiched between the restriction roll 52 and the associated support roll 72. The restriction roll 52 rotates following the continuous sheet P being conveyed. In this manner, the restriction roll 52 restricts movement, in the width direction of the continuous sheet P, of the end portion, located on the deep side in the width direction of the continuous sheet P, of the continuous sheet P. When moved to the movement permission position (i.e., separated from the continuous sheet P), as shown in FIG. 1, the restriction roll 52 allows a portion, opposed to the droplets ejecting heads 22, of the continuous sheet P to move in its width direction.

[Tension Applying Mechanisms 60]

As shown in FIGS. 5 and 8, the plural tension applying mechanisms 60 are disposed on the apparatus front side of the continuous sheet P in its width direction on the opposite side of a portion, opposed to the droplets ejecting heads 22, of the continuous sheet P to the support mechanisms 70. The tension applying mechanisms 60 serve to apply tension to that portion of the continuous sheet P in its width direction.

As shown in FIG. 5, each tension applying mechanism 60 is equipped with a slant roll 62 which is an example tension application member and a switching member 64 which is an example second switching member.

The switching member 64 is equipped with a support portion 64A which supports the slant roll 62 rotatably, a cylindrical rod 64B which extends upward from the support portion 64A, and a body portion 64C which moves the support portion 64A in the vertical direction via the rod 64B and rotates the support portion 64A with the rod 64B as a rotation axis.

In the above structure, the control unit 38 (see FIG. 11) controls the switching member 64 to move the slant roll 62 in the vertical direction between a contact position (see FIG. 5) where it is in contact with the continuous sheet P and a separation position (see FIG. 4) where it is separated from the continuous sheet P.

Figure 2:
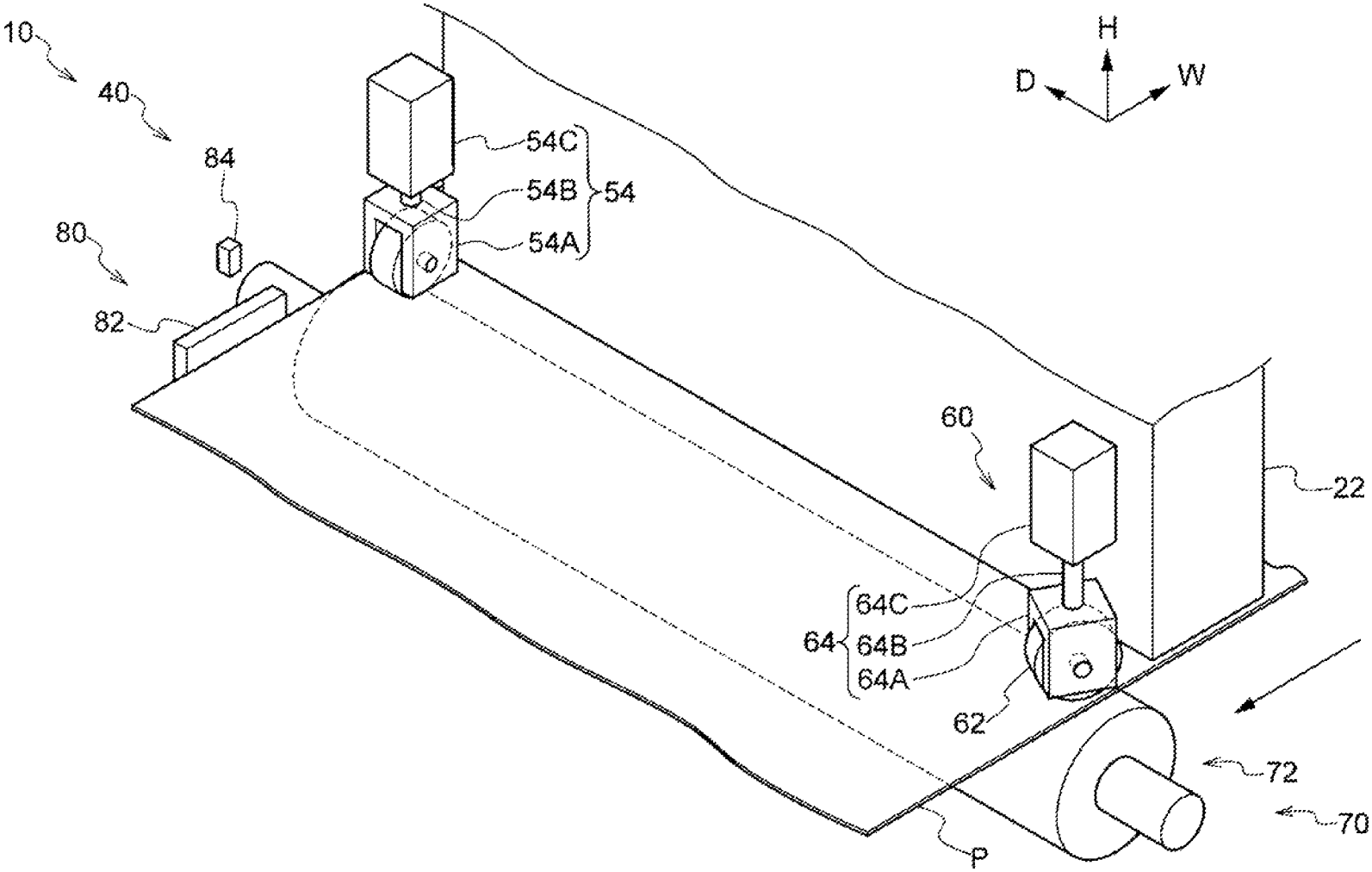
FIG. 2 is another perspective view of the restricting device of the image forming apparatus according to the first exemplary embodiment of the invention.
Figure 7:
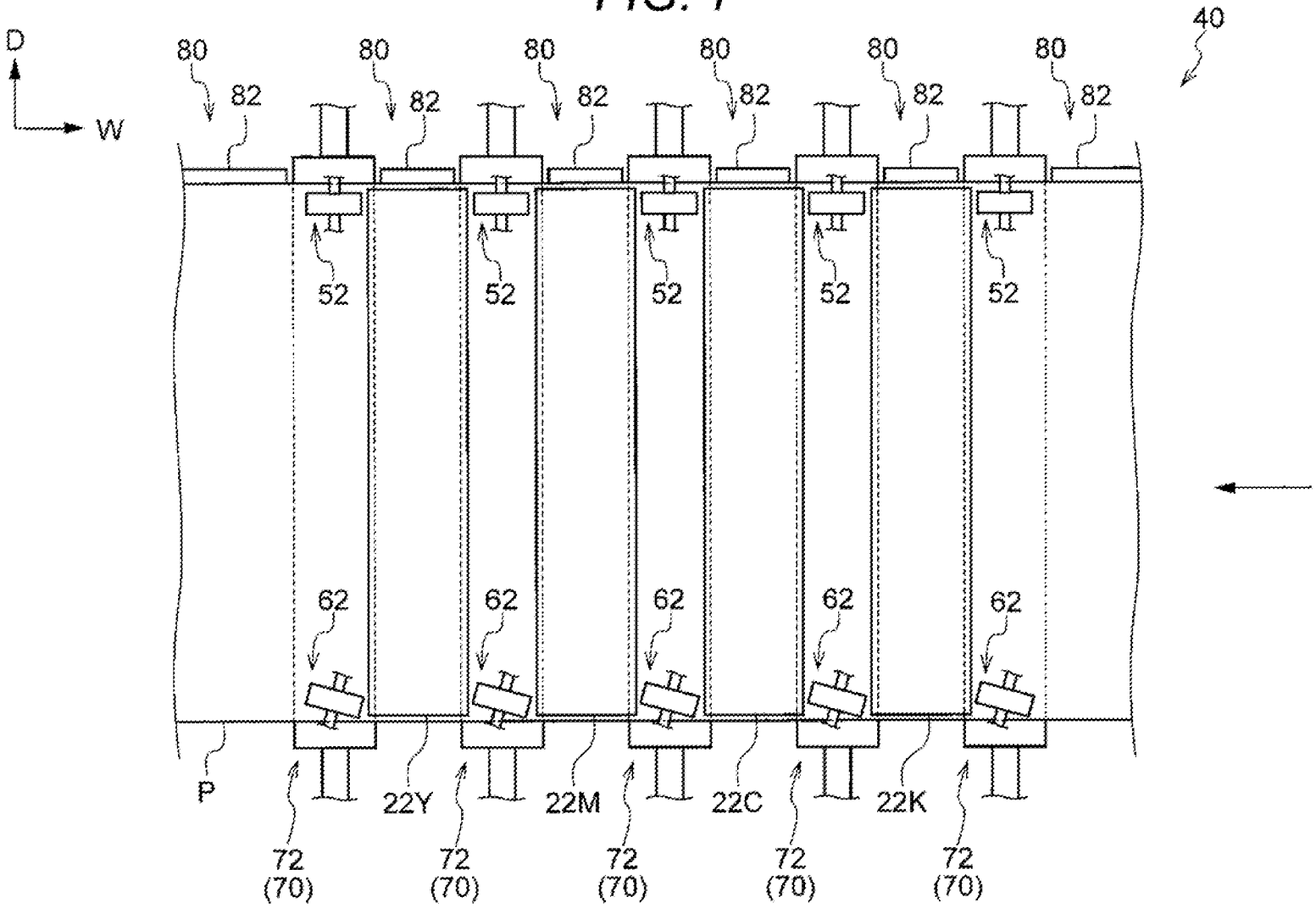
FIG. 7 is another plan view of the restricting device of the image forming apparatus according to the first exemplary embodiment of the invention.

Furthermore, the control unit 38 controls the switching member 64 to rotate the support portion 64A with the rod 64B as a rotation axis. The slant roll 62 is inclined so as to be oriented in one direction or the other direction with respect to the sheet conveying direction when viewed from above. More specifically, when inclined so as to be oriented in the one direction, as shown in FIGS. 5 and 8, when viewed from above, the slant roll 62 is oriented in such a manner that its downstream portion in the sheet conveying direction is located outside its upstream portion in the width direction of the continuous sheet P (i.e., on the side opposite to the associated movement restricting mechanism 50). When inclined so as to be oriented in the other direction, as shown in FIGS. 2 and 7, when viewed from above, the slant roll 62 is oriented in such a manner that its upstream portion in the sheet conveying direction is located outside its downstream portion in the width direction of the continuous sheet P.

When the slant roll 62 that is inclined so as to be oriented in the one direction is moved to the contact position, an end portion (the other end portion), located on the apparatus front side in the width direction of the continuous sheet P, of the continuous sheet P is sandwiched between the slant roll 62 and the associated support roll 72. The slant roll 62 rotates following the continuous sheet P being conveyed. In this manner, a portion, opposed to the droplets ejecting heads 22, of the continuous sheet P is given a force for moving that portion of the continuous sheet P outward in its width direction.

When the slant roll 62 that is inclined so as to be oriented in the other direction is moved to the contact position, an end portion (the other end portion), located on the apparatus front side in the width direction of the continuous sheet P, of the continuous sheet P is sandwiched between the slant roll 62 and the associated support roll 72. The slant roll 62 rotates following the continuous sheet P being conveyed. In this manner, a portion, opposed to the droplets ejecting heads 22, of the continuous sheet P is given a force for moving that portion of the continuous sheet P in its width direction (i.e., toward the associated guide plate 82).

(Operation of Essential Part)

Next, how the restricting device 40 operates will be described with referent to a flowchart of FIG. 10 and other drawings.

Figure 6:
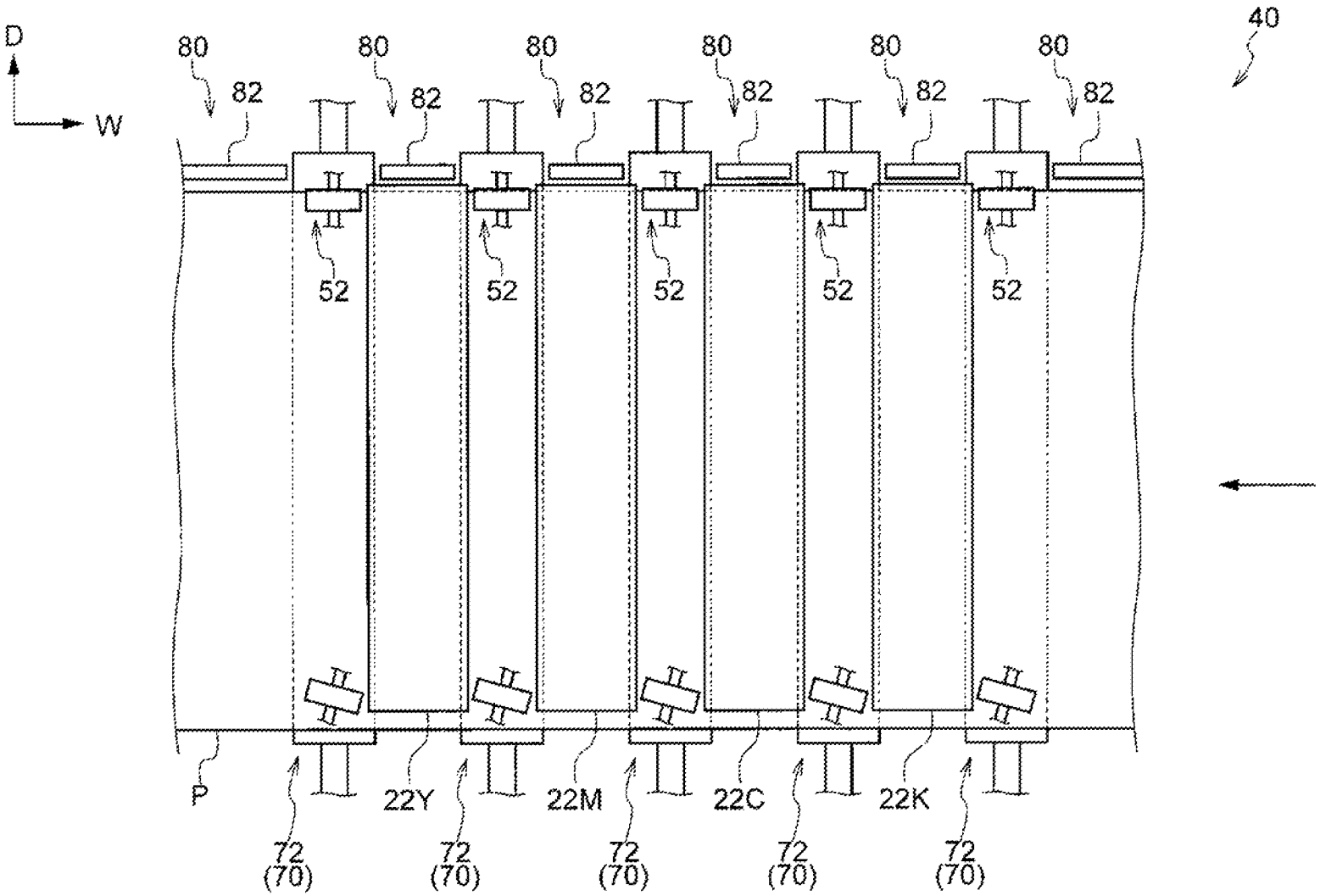
FIG. 6 is a plan view of the restricting device of the image forming apparatus according to the first exemplary embodiment of the invention.

First, while the image forming apparatus 10 is not in operation, as shown in FIG. 1, each restriction roll 52 is located at the movement permission position and each slant roll 62 is located at the separation position. Furthermore, the each slant roll 62 is inclined so as to be oriented in the other direction. As shown in FIG. 6, a gap is formed between each guide plate 82 and the one edge of a portion, opposed to the droplets ejecting heads 22, of the continuous sheet P.

Figure 10:
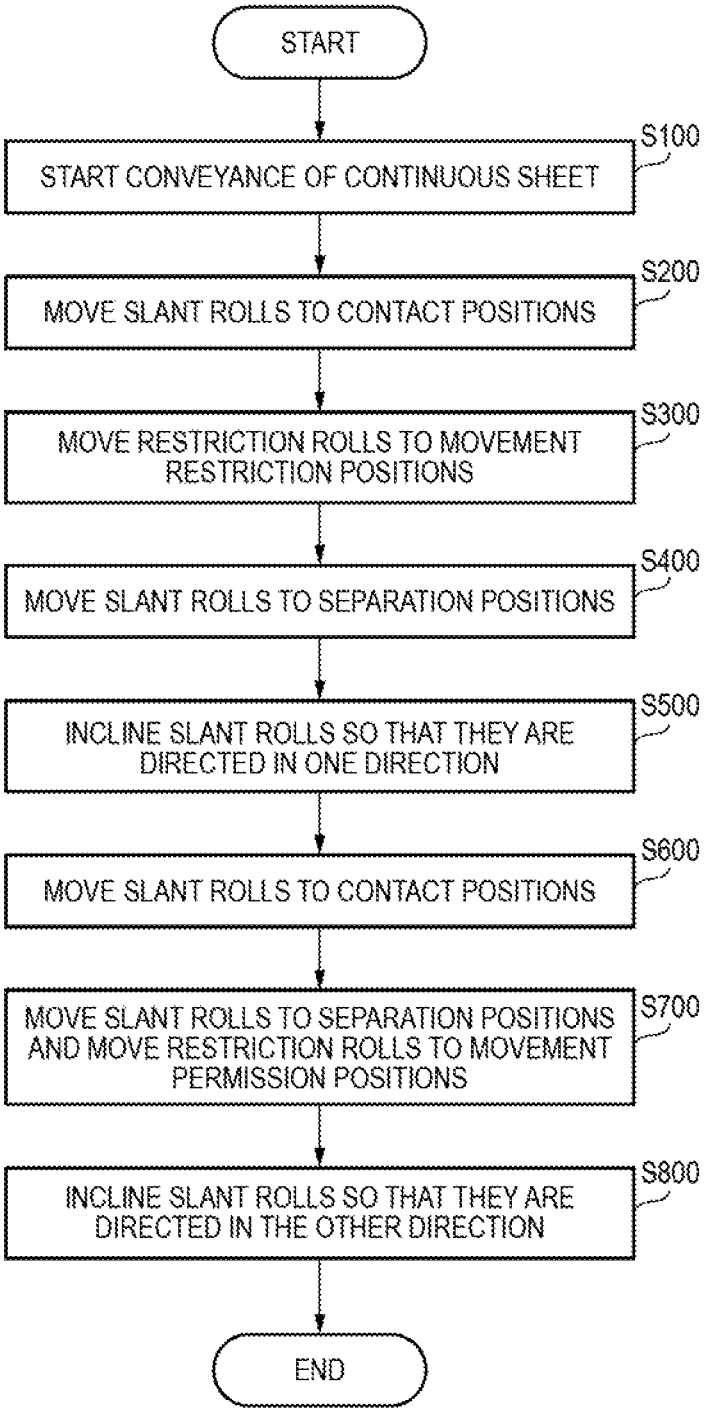
FIG. 10 is a control flowchart for the restricting device of the image forming apparatus according to the first exemplary embodiment of the invention.
Figure 11:
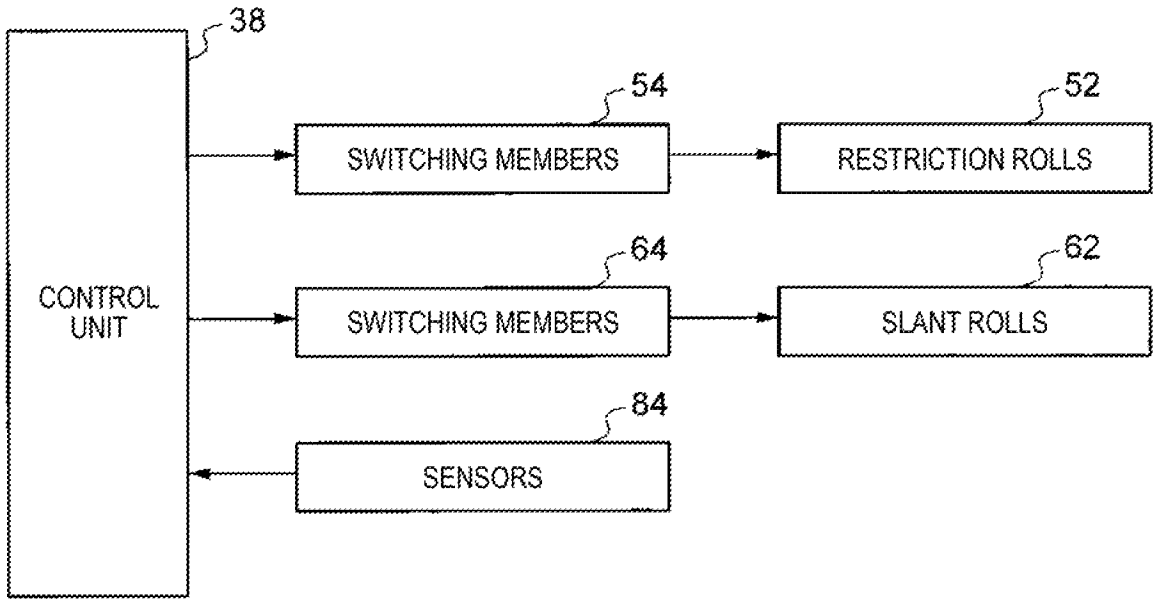
FIG. 11 is a block diagram of a control system of the restricting device of the image forming apparatus according to the first exemplary embodiment of the invention.

If the image forming apparatus 10 is put into operation in this state, conveyance of the continuous sheet P is started at step S100 (see FIG. 10).

At step S200, the control unit 38 controls the switching members 64 to move the slant rolls 62 from the separation positions to the contact positions (see FIGS. 2 and 7).

A portion, opposed to the droplets ejecting heads 22, of the continuous sheet P is sandwiched between the slant rolls 62 located at the contact positions and the support rolls 72, and the slant rolls 62 rotate following the continuous sheet P being conveyed. That portion of the continuous sheet P is given a force for moving it inward in its width direction.

As a result, the portion, opposed to the droplets ejecting heads 22, of the continuous sheet P is moved inward in its width direction and the one edge of that portion of the continuous sheet P comes into contact with the guide plates 82, whereby the guide plates 82 restrict the position of that portion of the continuous sheet P in its width direction. If all the sensors 84 have detected that the one edge of the portion, opposed to the droplets ejecting heads 22, of the continuous sheet P has come into contact with the respective guide plates 82, the process moves to step S300.

Figure 3:
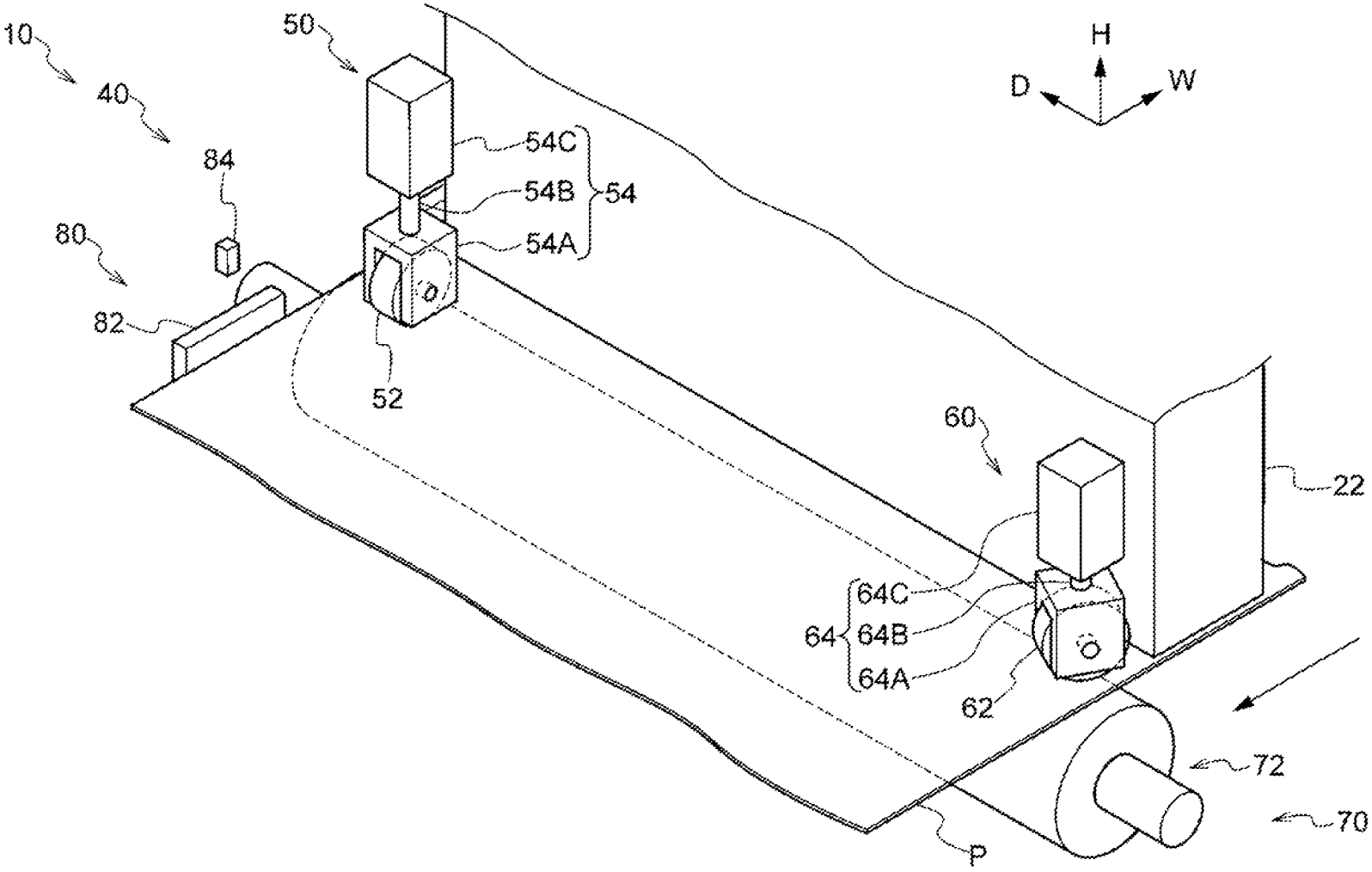
FIG. 3 is a still another perspective view of the restricting device of the image forming apparatus according to the first exemplary embodiment of the invention.

At step S300, the control unit 38 controls the switching members 54 to move the restriction rolls 52 from the movement permission positions to the movement restriction positions (see FIG. 3). A portion, opposed to the droplets ejecting heads 22, of the continuous sheet P is sandwiched between the restriction rolls 52 located at the movement restriction positions and the support rolls 72, and the restriction rolls 52 rotate following the continuous sheet P being conveyed. As a result, the restriction rolls 52 restrict movement, in the width direction of the continuous sheet P, of end portions, located on the deep side in the width direction of the continuous sheet P, of the continuous sheet P.

At step S400, the control unit 38 controls the switching members 64 to move the slant rolls 62 from the contact positions to the separation positions (see FIG. 3).

Figure 4:
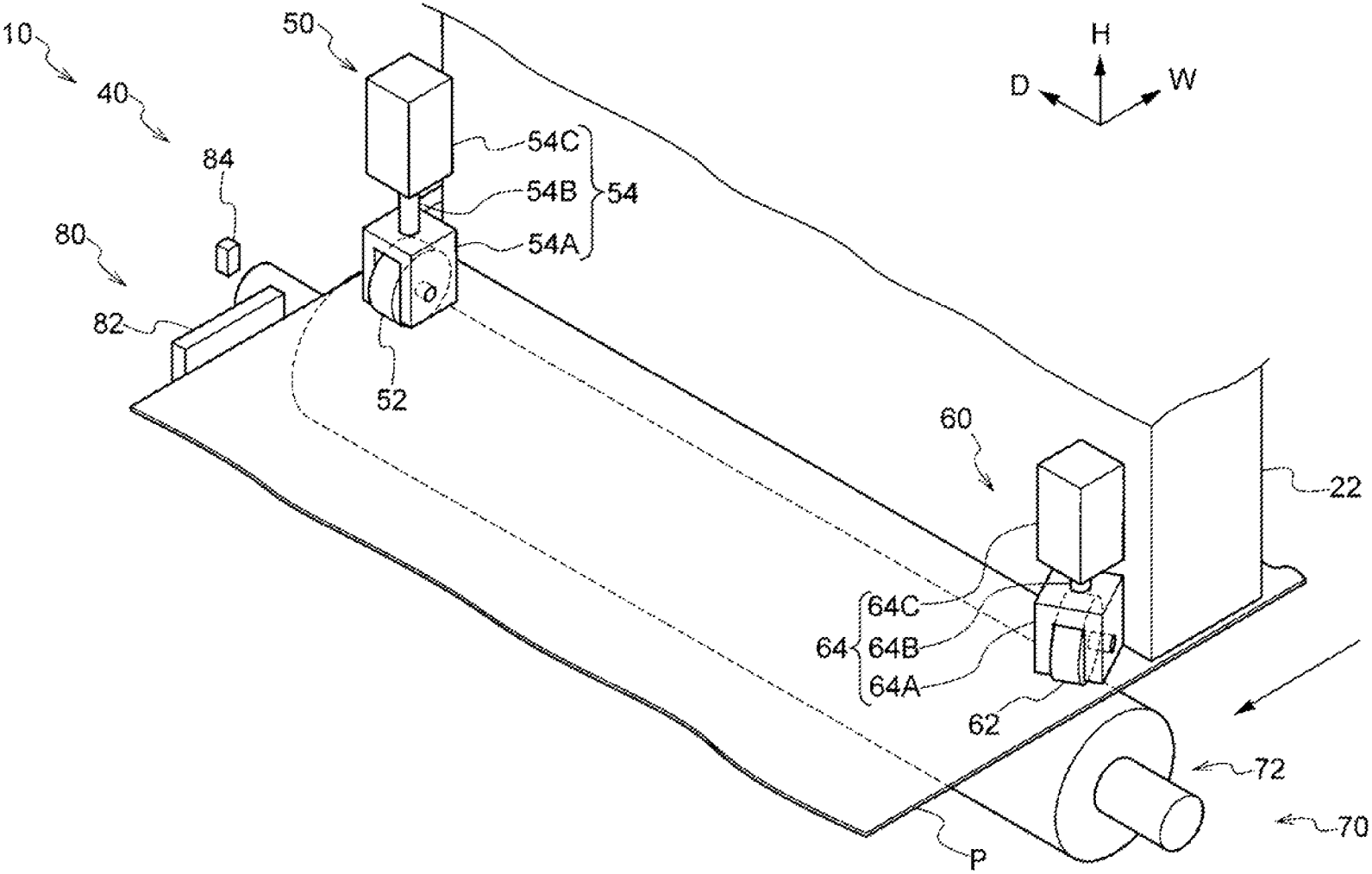
FIG. 4 is yet another perspective view of the restricting device of the image forming apparatus according to the first, exemplary embodiment of the invention.

At step S500, the control unit 38 controls the switching members 64 to change the inclination direction of the slant rolls 62 from the other direction to the one direction (see FIG. 4).

At step S600, the control unit 38 controls the switching members 64 to move the slant rolls 62 from the separation positions to the contact positions (see FIGS. 5 and 8).

A portion, opposed to the droplets ejecting heads 22, of the continuous sheet P is sandwiched between the slant rolls 62 located at the contact positions and the support rolls 72, and the slant rolls 62 rotate following the continuous sheet P being corn-eyed. That portion of the continuous sheet P is given a force for moving it outward in its width direction, whereby that portion of the continuous sheet P is given tension in its width direction.

Since the continuous sheet P is conveyed by rotating the take-up roll 28 (see FIG. 9), the continuous sheet P is given tension in the sheet conveying direction.

The droplets ejecting heads 22 of the respective colors eject droplets (ink droplets) of the respective colors in order onto the continuous sheet P to form an image thereon. Upon completion of the image forming job, the process moves to step S700.

At step S700, the control unit 38 controls the switching members 64 to move the slant rolls 62 from the contact positions to the separation positions. Furthermore, the control unit 38 controls the switching members 54 to move the restriction rolls 52 from the movement restriction positions to the movement permission positions.

At step S800, the control unit 38 controls the switching members 64 to change the inclination direction of the slant rolls 62 from the one direction to the other direction (see FIG. 1), whereupon the conveyance of the continuous sheet P is stopped and the process is finished.

(Summary)

Next, a restricting device 90 according to a comparative mode will be described and, furthermore, workings and advantages of the restricting device 40 used in the exemplary embodiment will be described by comparing it with the restricting device 90. As for the restricting device 90, differences from the restricting device 40 will be described mainly.

Figure 12:
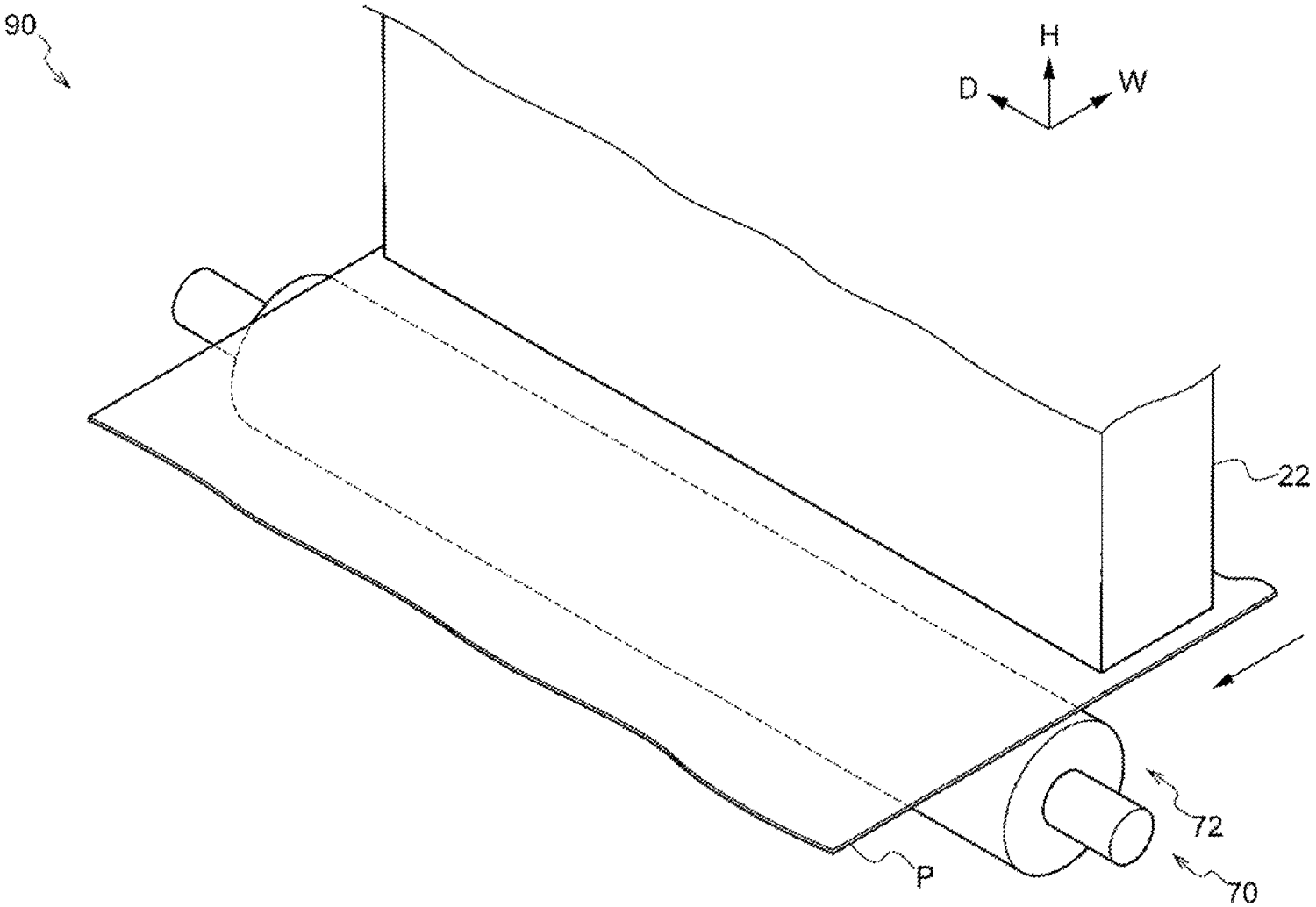
FIG. 12 shows a restricting device of an image forming apparatus for comparison with the image forming apparatus according to the first exemplary embodiment ox the invention.

As shown in FIG. 12, the restricting device 90 is not equipped with none of the movement restricting mechanisms 50, the tension applying mechanisms 60, and the guide mechanisms 80. Thus, the droplets ejecting heads 22 of the respective colors eject droplets of the respective colors in order onto a portion, opposed to the droplets ejecting heads 22 and not given tension in the width direction, of the continuous sheet P. As mentioned above, the continuous sheet P is given tension in the sheet conveying direction.

Droplet-deposited portions of the continuous sheet P are expanded in the sheet conveying direction. Thus, since the configuration is such that droplets of different colors are ejected onto the continuous sheet P, droplets deposition positions deviate from intended positions.

In contrast, in the restricting device 40, since the continuous sheet P is given tension in its width direction, the continuous sheet P is stretched in its width direction accordingly. As a result, in the restricting device 40, further expansion of droplets-deposited portions in the sheet conveying direction is made smaller than in the restricting device 90.

As seen from the above description, in the restricting device 40, the phenomenon that droplets deposition positions deviate from intended positions is made less severe than in the restricting device 90.

Since deviation of droplets deposition positions is suppressed, degradation of the image quality is made smaller than in the restricting device 90.

Tension, is applied to the continuous sheet P in its width direction in such a manner that the slant rolls 62 that are inclined so as to be directed in the one direction rotate following the continuous sheet P being conveyed. That is, tension is applied to the continuous sheet P in its width direction without using any drive force.

The one edge of a portion, opposed to the droplets ejecting heads 22, of the continuous sheet P is brought into contact with the guide plates 82 by inclining the slant rolls 62 so that they are directed in the other direction. With this structure, the number of components is made smaller than in a case that the one edge of a portion, opposed to the droplets ejecting heads 22, of the continuous sheet P is brought into contact with the guide plates 82 using dedicated members.

Exemplary Embodiment 2

Figure 13:
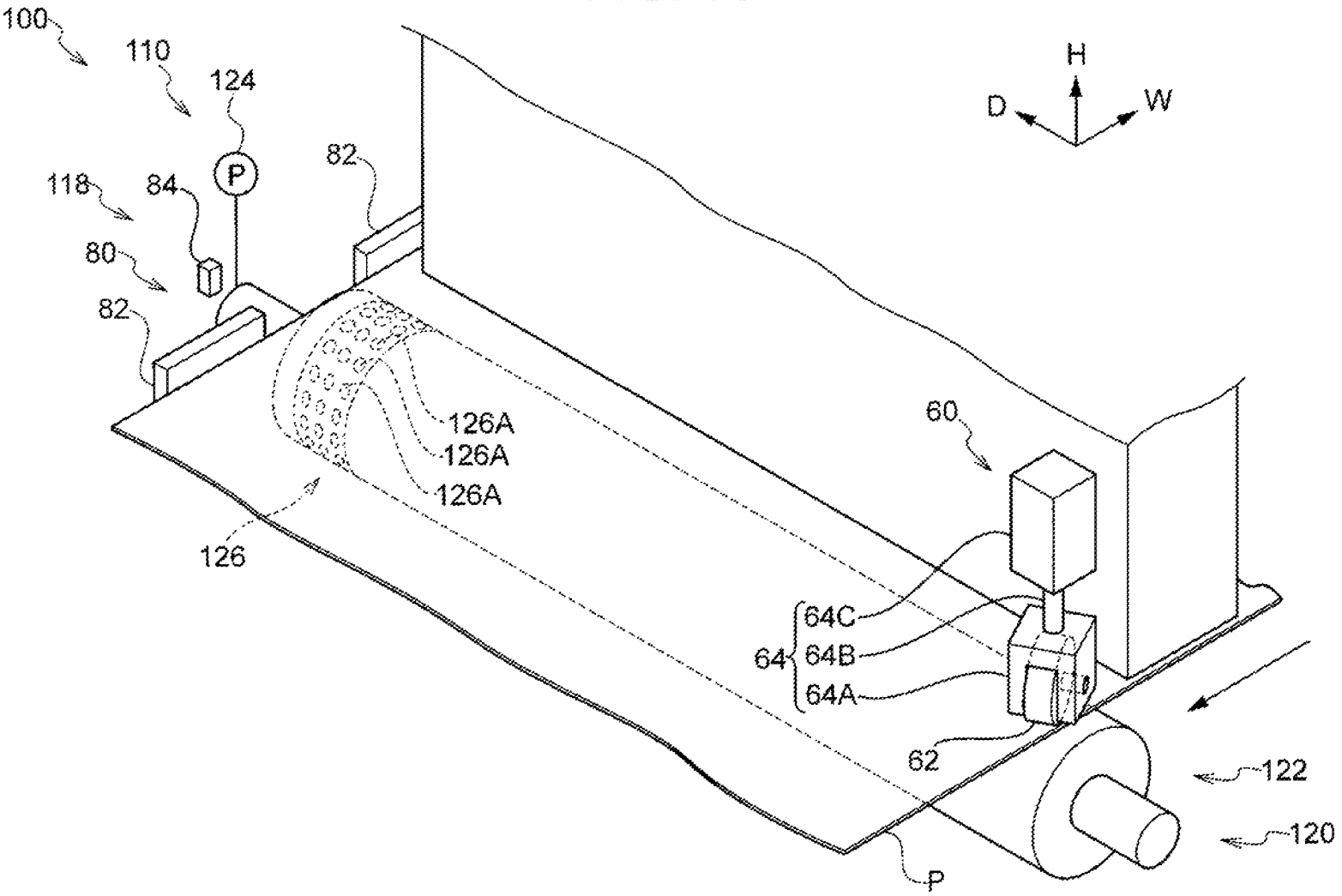
FIG. 13 is a perspective view of a restricting device of an image forming apparatus according to a second exemplary embodiment of the invention.
Figure 14:
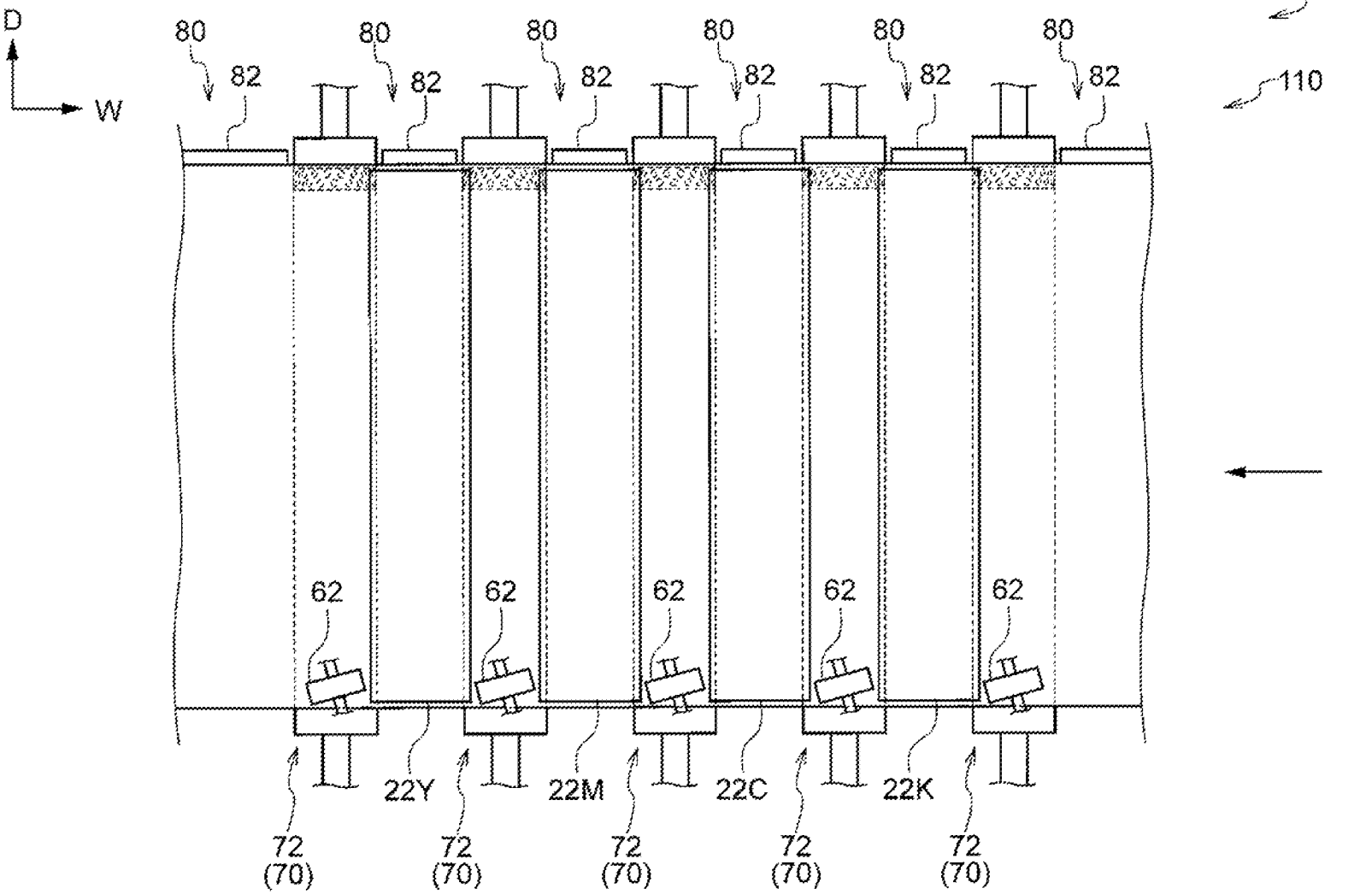
FIG. 14 is a plan view of the restricting device of the image forming apparatus according to the second exemplary embodiment of the invention.
Figure 15:
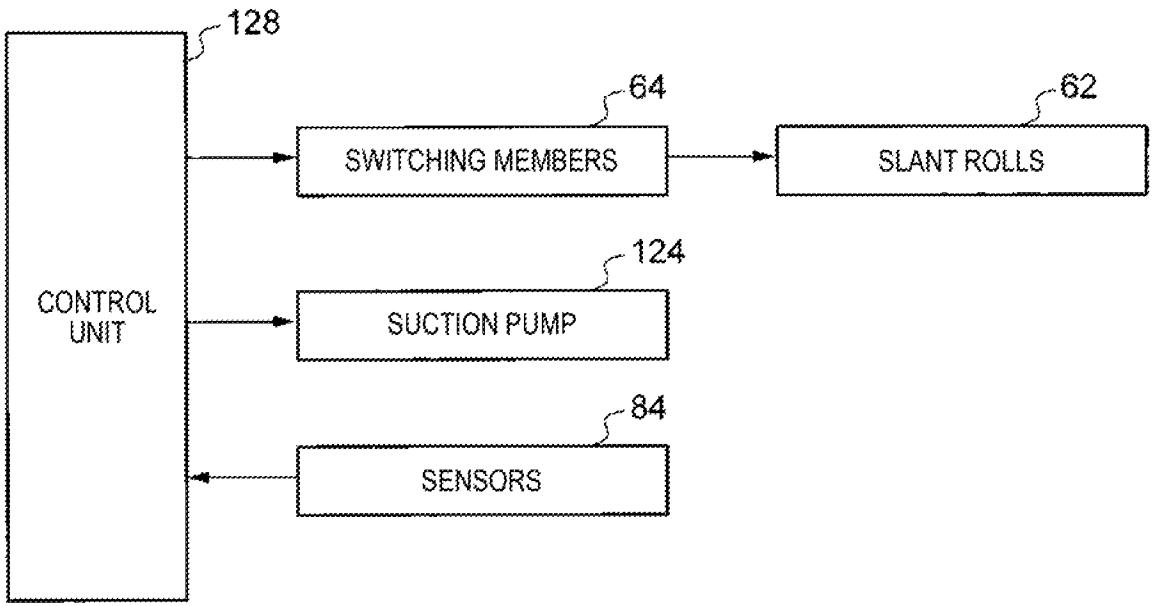
FIG. 15 is a block diagram of a control system of the restricting device of the image forming apparatus according to the second exemplary embodiment of the invention.
Figure 16:
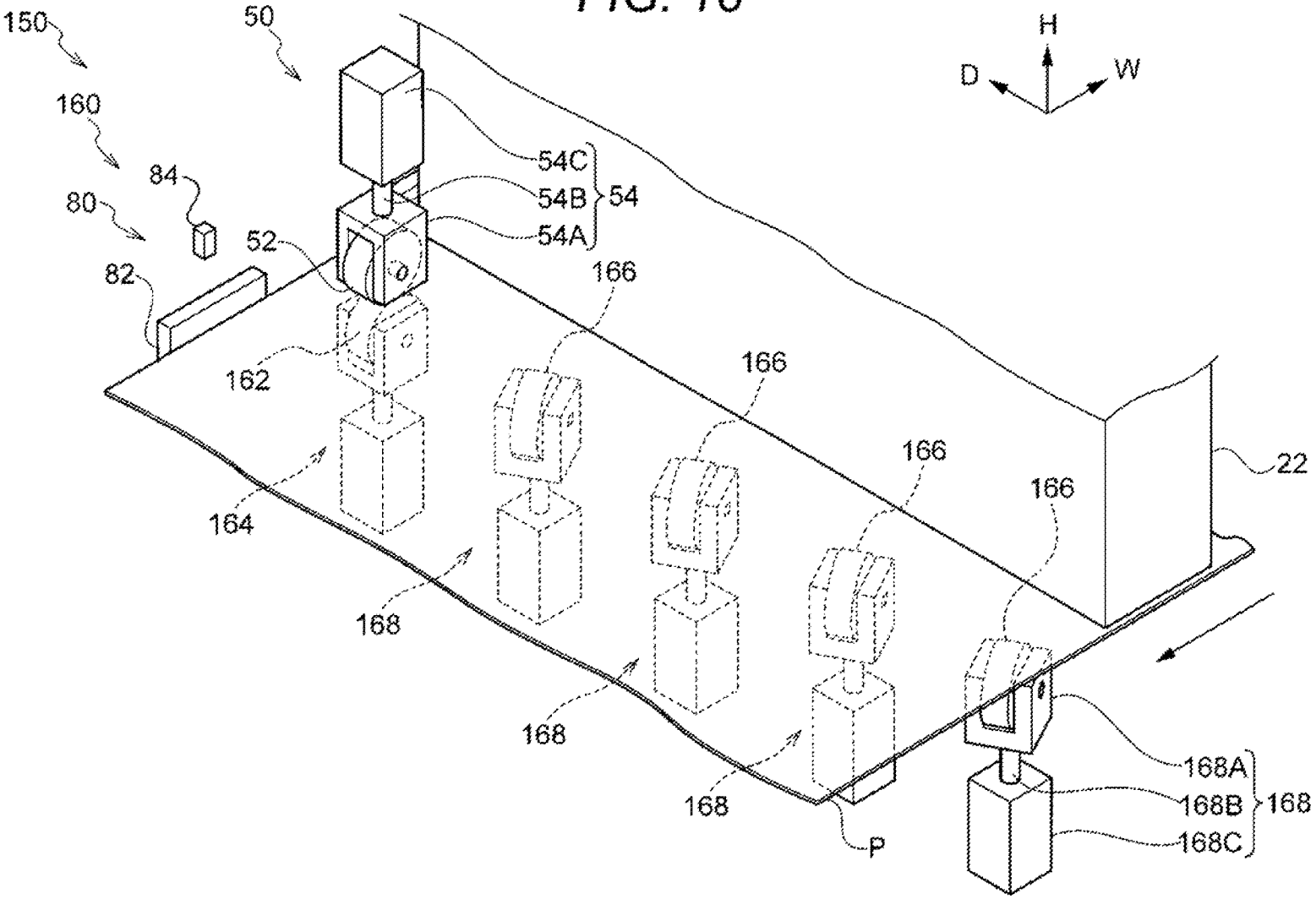
FIG. 16 is a perspective view of a restricting device of an image forming apparatus according to a third exemplary embodiment of the invention.

Next, an image forming apparatus 100 according to a second exemplary embodiment will be described with reference to FIGS. 13-15. As for the image forming apparatus 100, differences from the image forming apparatus 10 according to the first exemplary embodiment will be described mainly.

(Configuration)

The image forming apparatus 100 is equipped with a control unit 128 (see FIG. 15) and a restricting device 110. As shown in FIGS. 13 and 14, the restricting device 110 is not equipped with the movement restricting mechanisms 50. The restricting device 110 is equipped with a suction pump 124 which is an example first switching device and plural support mechanisms 120 which are disposed on the non-image-formation side of a portion, opposed to the droplets ejecting heads 22, of the continuous sheet P.

Each support mechanism 120 is equipped with a support roll 122 which supports the continuous sheet P fully in its width direction. The support roll 122 is a hollow roll and is supported rotatably by the frame member (not shown).

A portion, located on the deep side in the width direction of the continuous sheet P, of the support roll 122 is formed with a circumferential absorption region 126 which is an example movement restriction member. The absorption region 126 is formed with plural suction openings 126A. When the suction pump 124 operates, air is sucked through the suction openings 126A, whereby a portion, located on the deep side in the width direction of the continuous sheet P, of the continuous sheet P is absorbed on the absorption region 126.

In the image forming apparatus 100 having the above configuration, in a movement restriction state, the control unit 128 causes the suction pump 124 to operate and thereby restricts movement, in the width direction of the continuous sheet P, of an end portion, located on the deep side in the width direction of the continuous sheet P, of the continuous sheet P. In a movement permission state, the control unit 128 suspends operation of the suction pump 124 and thereby allows a portion, opposed to the droplets ejecting heads 22, of the continuous sheet P to move in its width direction.

The restricting device 110 of the image forming apparatus 100 according to the second exemplary embodiment is the same as the restricting device 40 of the image forming apparatus 10 according to the first exemplary embodiment except that the absorption regions 12 restrict movement of a portion, opposed to the droplets ejecting heads 22, of the continuous sheet P.

Exemplary Embodiment 3

Next, an image forming apparatus 150 according to a third exemplary embodiment will be described with reference to FIGS. 16-20. As for the image forming apparatus 150, differences from the image forming apparatus 10 according to the first exemplary embodiment will be described mainly.

(Configuration)

The image forming apparatus 150 is equipped with a control unit 178 (see FIG. 20) and a restricting device 160. The restricting device 160 is equipped with holding rolls 162 which are disposed on the opposite side of the continuous sheet P to the restriction rolls 52 so as to be opposed to the respective restriction rolls 52 (see FIG. 16). The restricting device 160 is also equipped with slant rolls 166 which are example tension application members and switching members 168 which are example second switching members. The slant rolls 166 are disposed on the non-image-formation side of the continuous sheet P.

Each holding roll 162 is disposed in such a manner that its rotation plane (i.e., the plane that is perpendicular to its axis) is parallel with the sheet conveying direction, and is supported by a bracket 164 rotatably.

In each set of slant rolls 166, the slant rolls 166 are arranged at the same interval in the width direction of the continuous sheet P on the apparatus front side of the associated holding roll 126 in the width direction of the continuous sheet P.

Each switching member 168 is equipped with a support portion 168A which supports the slant roll 168 rotatably, a cylindrical rod 168B which extends downward from the support portion 168A, and a body portion 168C which rotates the support portion 168A with the rod 168B as a rotation axis.

In the above structure, the control unit 178 (see FIG. 20) controls the switching member 168 to rotate the support portion 168A with the rod 168B as a rotation axis. The slant roll 166 is inclined so as to be oriented in one direction (see FIG. 8) or the other direction (FIG. 17) with respect to the sheet conveying direction when viewed from above.

(Operation)

Next, how the restricting device 160 operates will be described with reference to a flowchart of FIG. 19 and other drawings.

Figure 17:
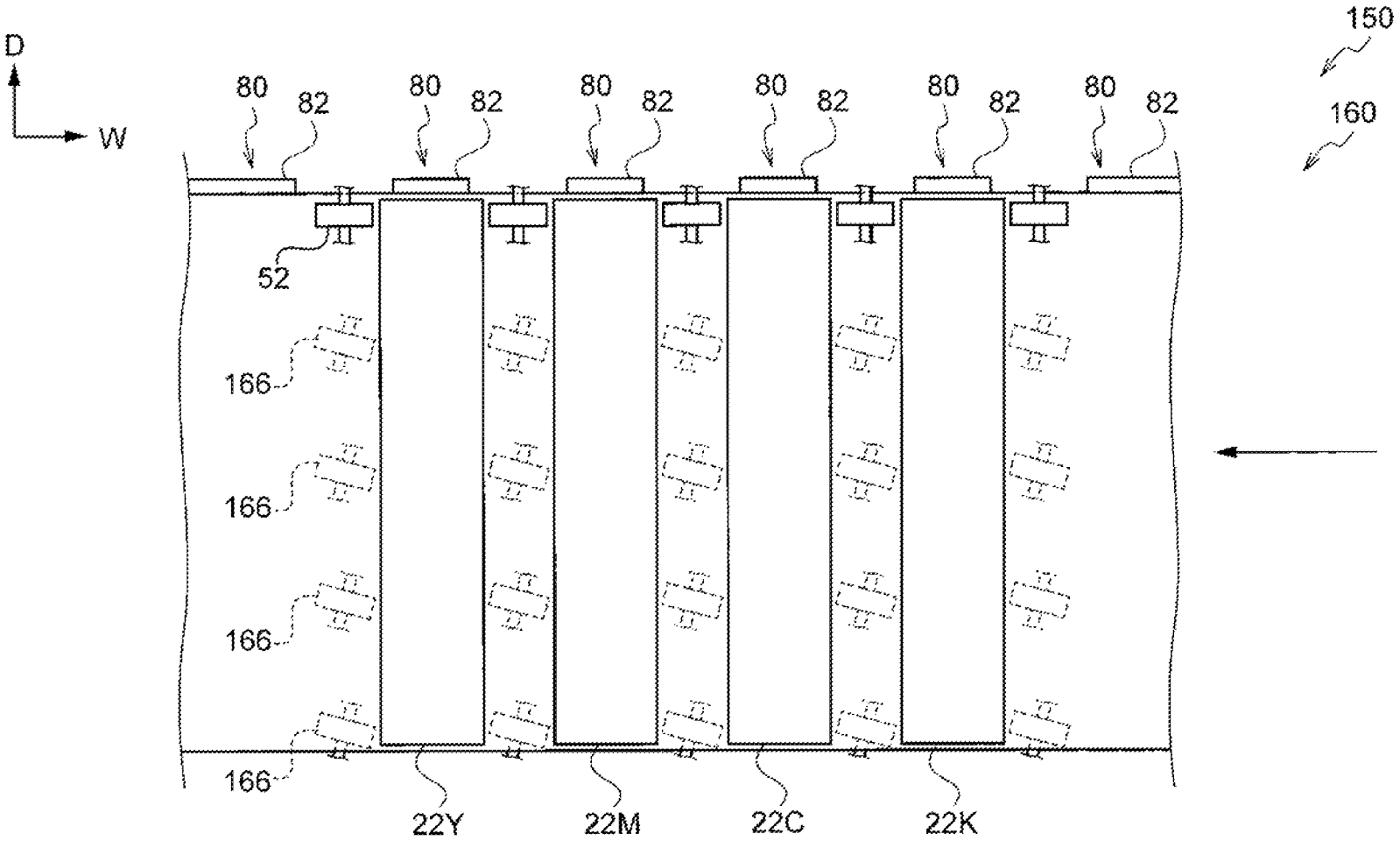
FIG. 17 is a plan view of the restricting device of the image forming apparatus according to the third exemplary embodiment of the invention.
Figure 18:
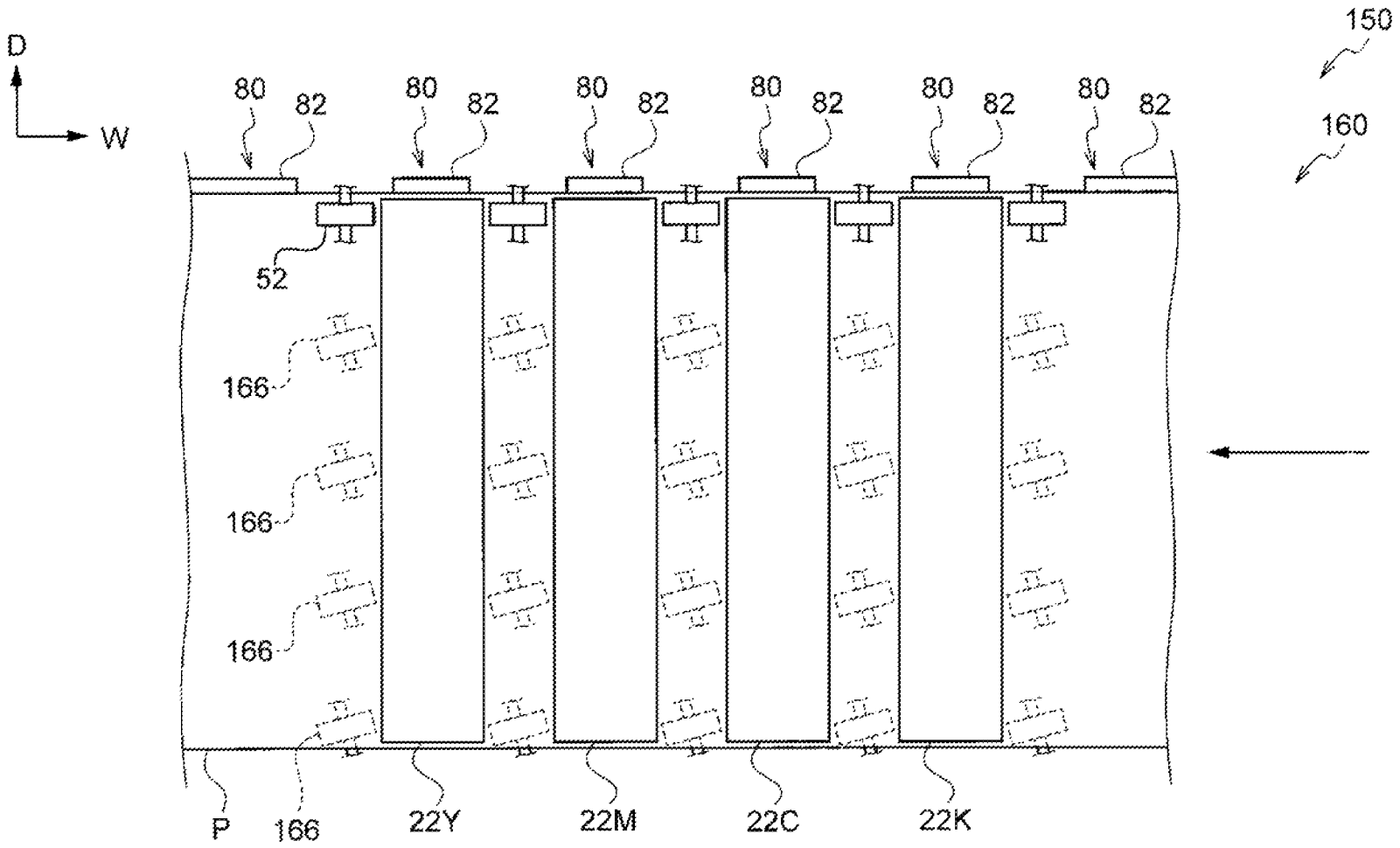
FIG. 18 is another plan view of the restricting device of the image forming apparatus according to the third exemplary embodiment of the invention.

First, while the image forming apparatus 150 is not in operation, as shown in FIG. 17, each restriction roll 52 is located at the movement permission position and each slant roll 166 is inclined so as to be oriented in the other direction. Gaps are formed between the one edge of a portion, opposed to the droplets ejecting heads 22, of the continuous sheet P and the guide plates 82.

Figure 19:
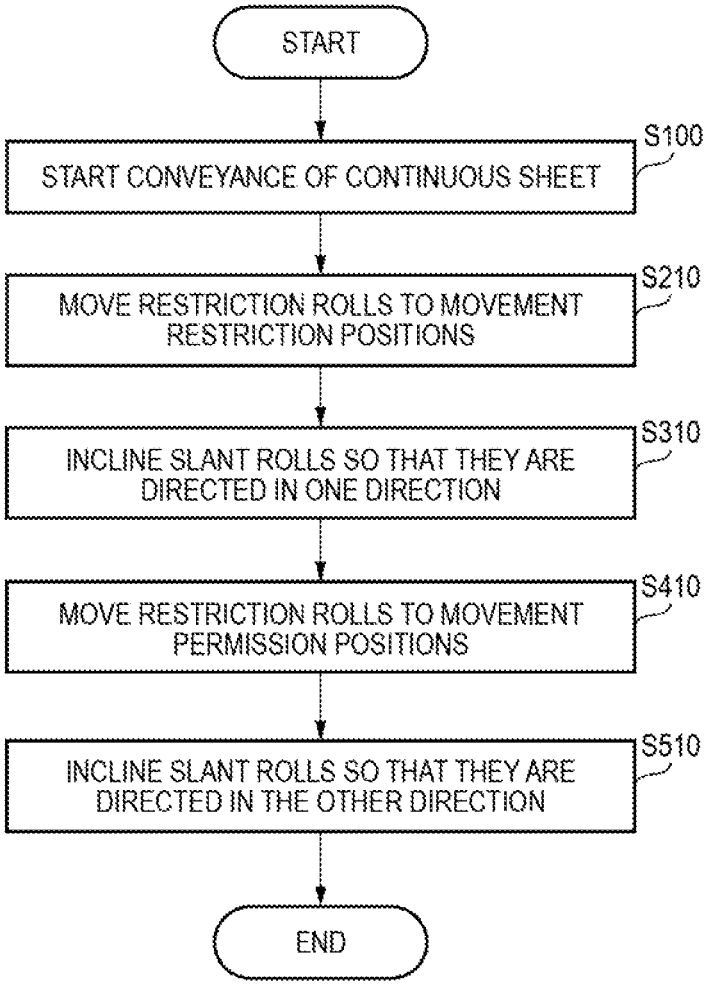
FIG. 19 is a control flowchart for the restricting device of the image forming apparatus according to the third exemplary embodiment of the invention.
Figure 20:
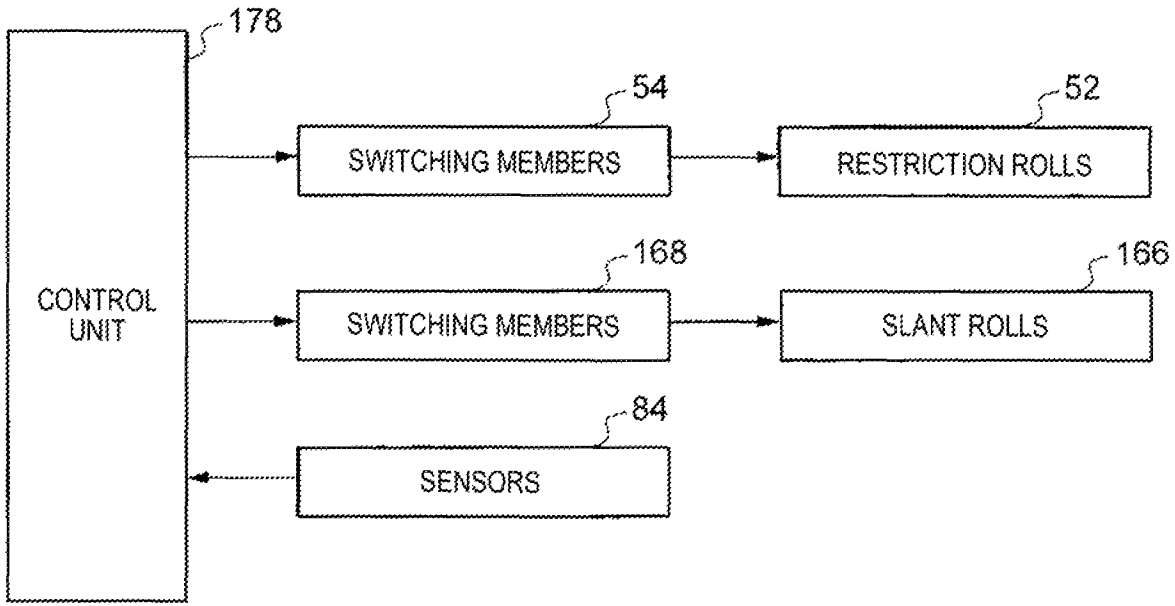
FIG. 20 is a block diagram of a control system of the restricting device of the image forming apparatus according to the third exemplary embodiment of the invention.

If the image forming apparatus 150 is put into operation in this state, conveyance of the continuous sheet P is started at step S100 (see FIG. 19). The slant rolls 62 that are inclined so as to be oriented in the other direction rotate following the continuous sheet P being conveyed. As a result, a portion, opposed to the droplets ejecting heads 22, of the continuous sheet P is given a force for moving that portion of the continuous sheet P inward in its width direction.

The portion, opposed to the droplets ejecting heads 22, of the continuous sheet P is moved inward in its width direction and the one edge of that portion of the continuous sheet P comes into contact with the guide plates 82, whereby the guide plates 82 restrict the position of that portion of the continuous sheet P in its width direction. If all the sensors 84 have detected that the one edge of the portion, opposed to the droplets ejecting heads 22, of the continuous sheet P has come into contact with the respective guide plates 82, the process moves to step S210.

At step S210, the control unit 178 controls the switching members 54 to move the restriction rolls 52 from the movement permission positions to the movement restriction positions. A portion, opposed to the droplets ejecting heads 22, of the continuous sheet P is sandwiched between the restriction rolls 52 located at the movement restriction positions and the respective holding rolls 162, and the restriction rolls 52 rotate following the continuous sheet P being conveyed. As a result, the restriction rolls 52 restrict movement, in the width direction of the continuous sheet P, of end portions, located on the deep side in the width direction of the continuous sheet P, of the continuous sheet P.

At step S310, the control unit 178 controls the switching members 168 to change the inclination direction of the slant rolls 166 from the other direction to the one direction (see FIG. 18), whereby a portion, opposed to the droplets ejecting heads 22, of the continuous sheet P is given tension that is directed outward in its width direction. The droplets ejecting heads 22 of the respective colors eject droplets of the respective colors in order onto the continuous sheet P to form an image thereon. Upon completion of the image forming job, the process moves to step S410.

At step S410, the control unit 178 controls the switching members 54 to move the restriction rolls 52 from the movement restriction positions to the movement permission positions.

At step S510, the control unit 178 controls the switching members 168 to change the inclination direction of the slant rolls 166 from the one direction to the other direction, whereupon the conveyance of the continuous sheet P is stopped and the process is finished.

The other part of the operation of the restricting device 160 of the image forming apparatus 150 according to the third exemplary embodiment is the same as that of the restricting device 40 of the image forming apparatus 10 according to the first exemplary embodiment.

Exemplary Embodiment 4

Figure 21:
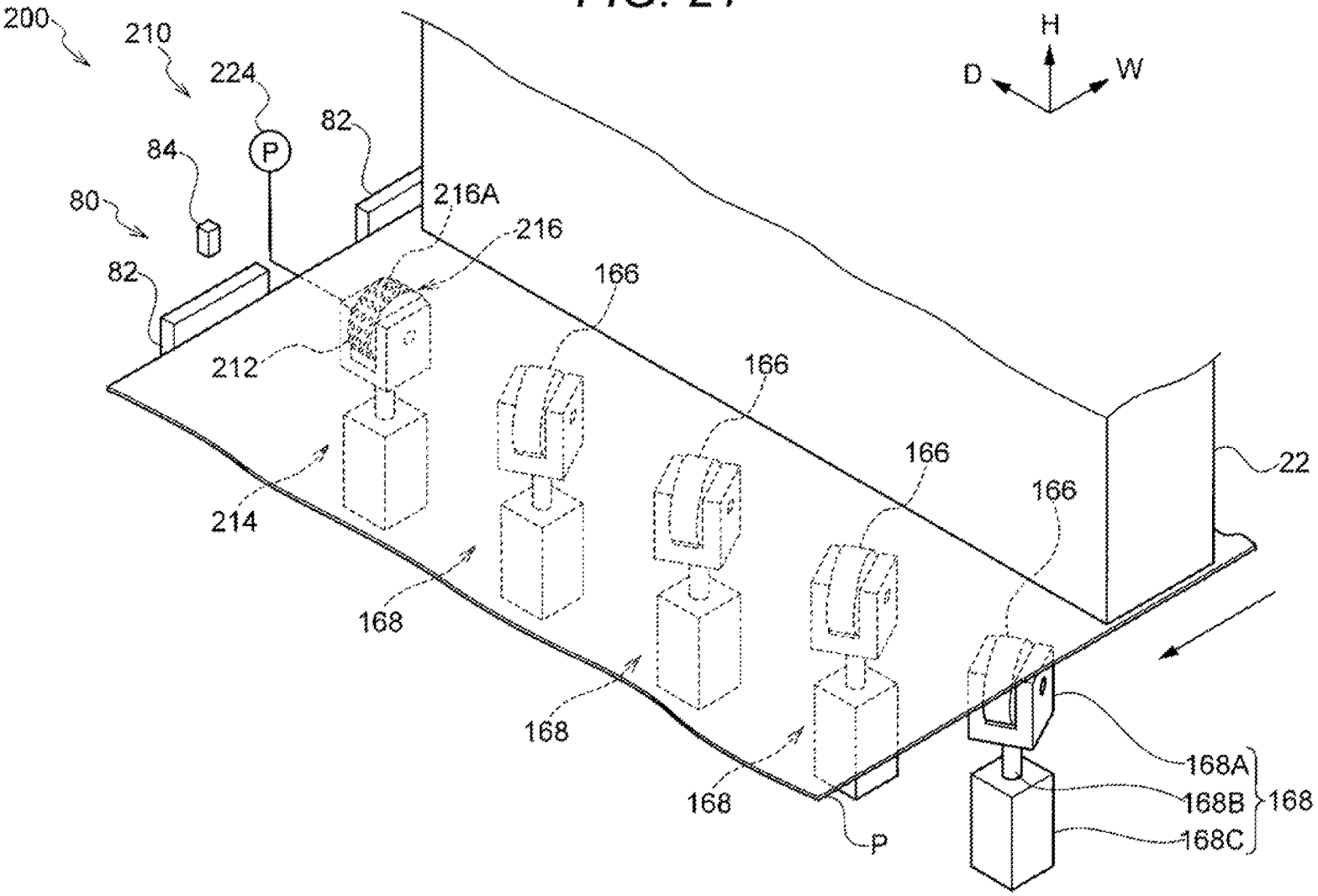
FIG. 21 is a perspective view of a restricting device of an image forming apparatus according to a fourth exemplary embodiment of the invention.
Figure 22:
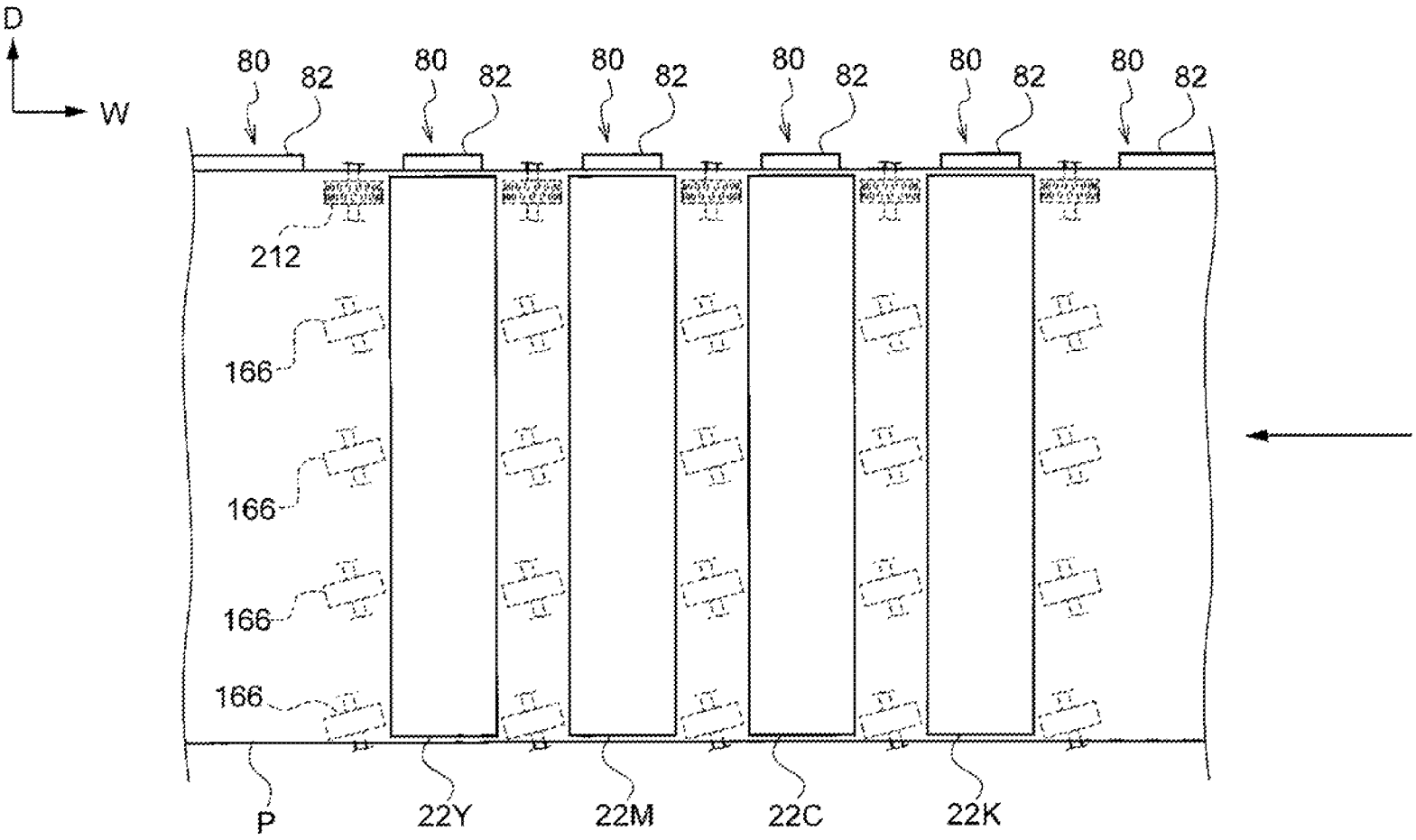
FIG. 22 is a plan view of the restricting device of the image forming apparatus according to the fourth exemplary embodiment of the invention.
Figure 23:
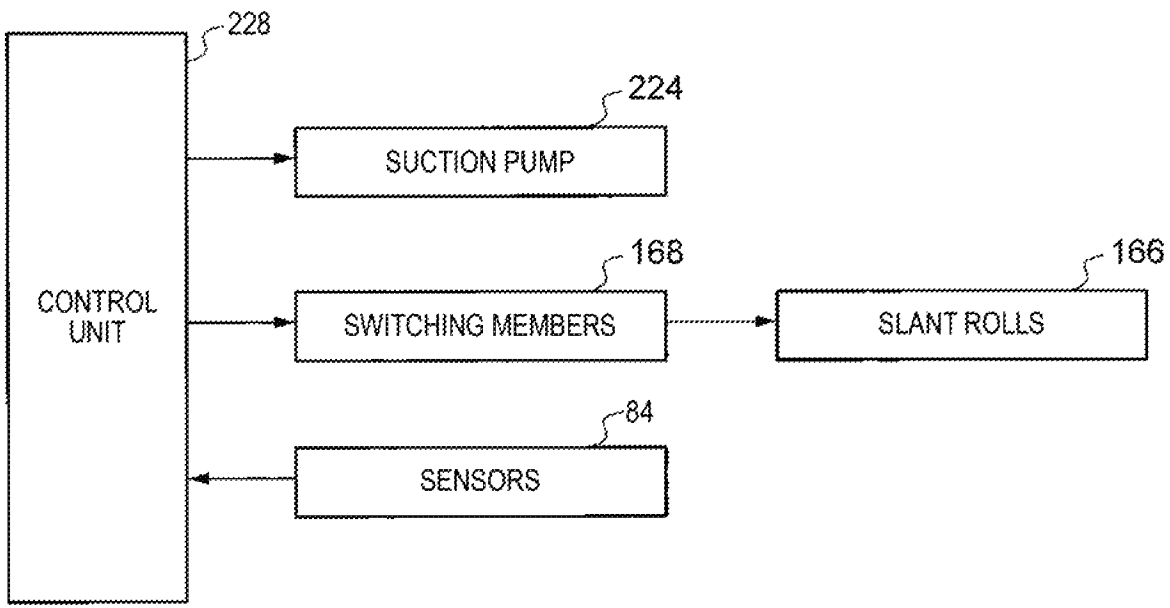
FIG. 23 is a block diagram of a control system of the restricting device of the image forming apparatus according to the fourth exemplary embodiment of the invention.

Next, an image forming apparatus 200 according to a fourth exemplary embodiment will be described with reference to FIGS. 21-23. As for the image forming apparatus 200, differences from the image forming apparatus 150 according to the third exemplary embodiment will be described mainly.

(Configuration)

The image forming apparatus 200 is equipped with a control unit 228 (see FIG. 23) for controlling individual components and a restricting device 210. As shown in FIGS. 21 and 22, the restricting device 210 is equipped with neither the movement restricting mechanisms 50 nor the holding rolls 162. The restricting device 210 is equipped with a suction pump 224 which is an example first switching device and suction rolls 212.

Each suction roll 212 is disposed on the deep side, in the width direction of the continuous sheet P, of the associated plural slant rolls 166. Each suction roll 212 is supported by a bracket 214 rotatably. The rotation plane (i.e., the plane that is perpendicular to its axis) of each suction roll 212 is parallel with the sheet conveying direction.

Each suction roll 212 is a hollow roll and its circumferential wall is formed with an absorption region 216 which is an example movement restriction member and has plural suction openings 216A.

When the suction pump 224 operates, air is sucked through the suction openings 216A, whereby a portion, located on the deep side in the width direction of the continuous sheet P, of the continuous sheet P is absorbed on the absorption region 216.

In the above configuration, in a movement restriction state, the control unit 228 of the image forming apparatus 200 causes the suction pump 224 to operate and thereby restricts movement, in the width direction of the continuous sheet P, of an end portion, located on the deep side in the width direction of the continuous sheet P, of the continuous sheet P. In a movement permission state, the control unit 228 suspends operation of the suction pump 224 and thereby allows a portion, opposed to the droplets ejecting heads 22, of the continuous sheet P to move in its width direction.

The restricting device 210 of the image forming apparatus 200 according to the fourth exemplary embodiment operates in the same manner as the restricting device 160 of the image forming apparatus 150 according to the third exemplary embodiment except that the absorption regions 216 restrict movement of a portion, opposed to the droplets ejecting heads 22, of the continuous sheet P.

Exemplary Embodiment 5

Next, an image forming apparatus 250 according to a fifth exemplary embodiment will be described with reference to FIGS. 24-27. As for the image forming apparatus 250, differences from the image forming apparatus 10 according to the first exemplary embodiment will be described mainly.

(Configuration)

Figure 24:
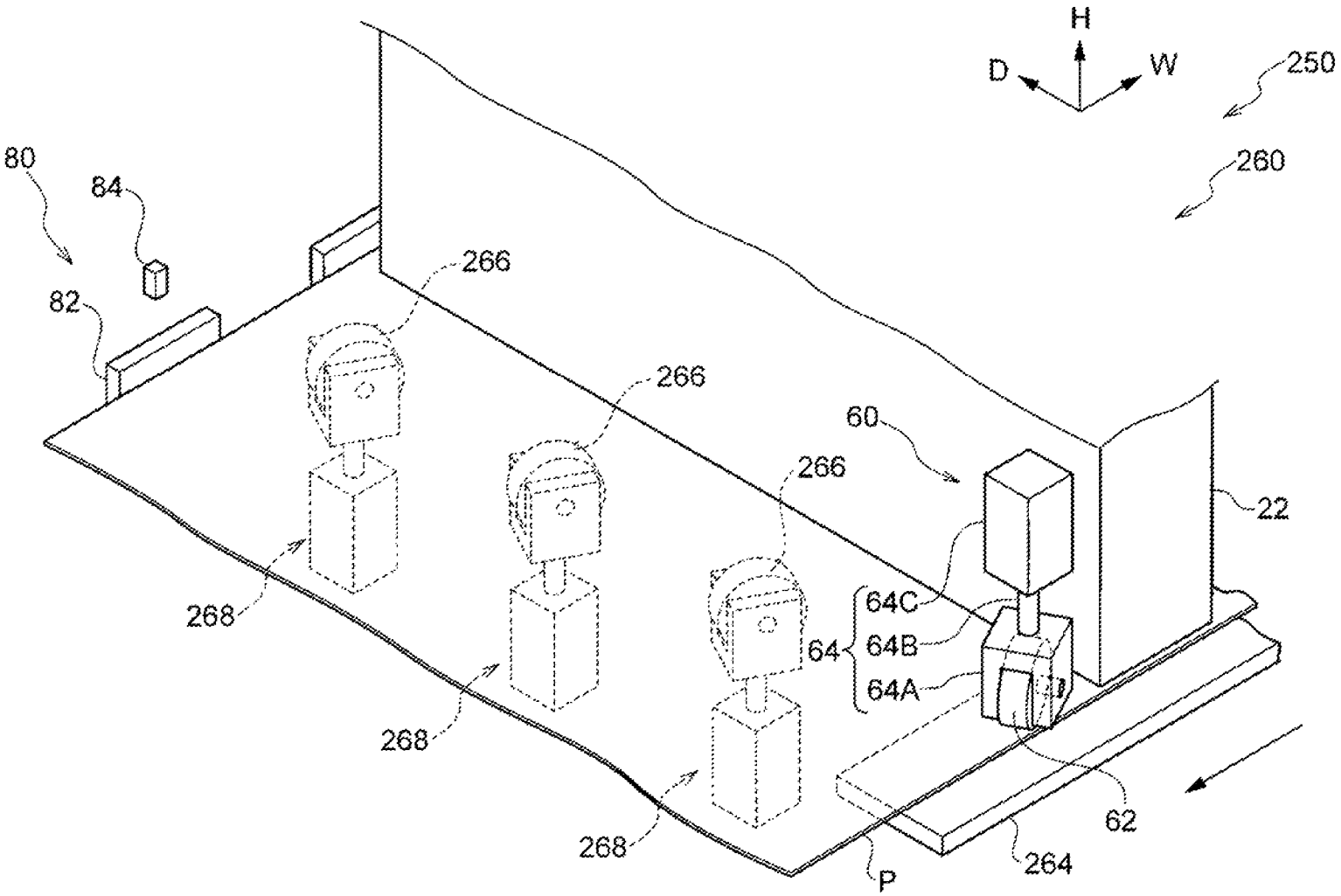
FIG. 24 is a perspective view of a restricting device of an image forming apparatus according to a fifth exemplary embodiment of the invention.
Figure 25:
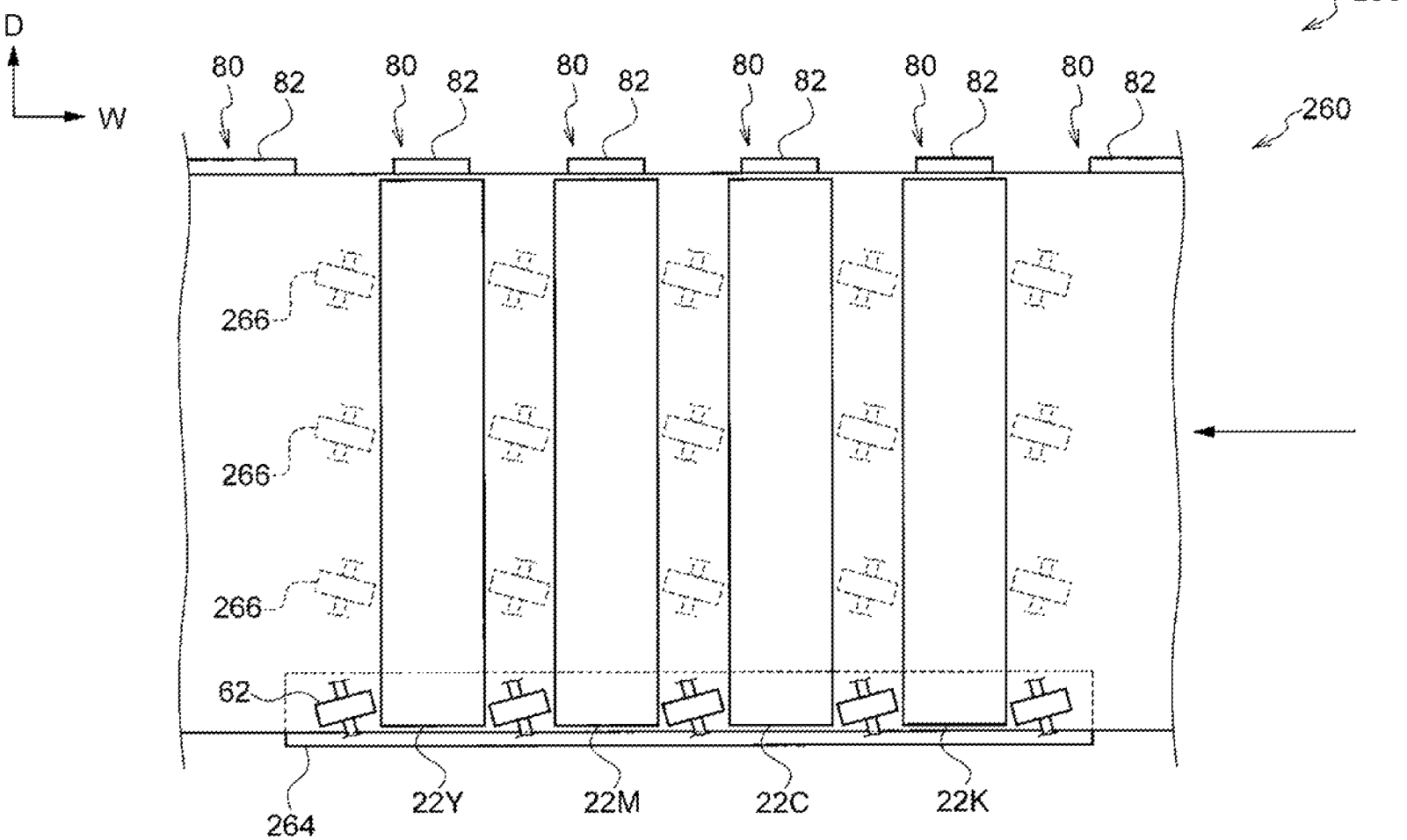
FIG. 25 is a plan view of the restricting device of the image forming apparatus according to the fifth exemplary embodiment of the invention.

The image forming apparatus 250 is equipped with a control unit 278 (see FIG. 27) for controlling individual components and a restricting device 260. As shown in FIGS. 24 and 25, the restricting device 260 is equipped with neither the movement restricting mechanisms 50 nor the support mechanisms 70. The restricting device 210 is equipped with a support plate 264 which is disposed on the opposite side of a portion, opposed to the droplets ejecting heads 22, of the continuous sheet P to slant rolls 62 which is disposed at contact positions and support rolls 266 which are arranged in the width direction of the continuous sheet P.

The support plate 264 extends in the sheet conveying direction and supports a portion, located on the apparatus front side in the sheet conveying direction, of the continuous sheet P from below.

Plural support rolls 266 are arranged at the same interval in the width direction of the continuous sheet P on the deep side of each slant roll 62 in the width direction of the continuous sheet P and on the non-image-formation side of a portion, opposed to the droplets ejecting heads 22, of the continuous sheet P. The support rolls 266 are inclined from the sheet conveying direction when viewed from above.

(Operation)

Next, how the restricting device 260 operates will be described with reference to a flowchart of FIG. 26 and other drawings.

First, while the image forming apparatus 250 is not in operation, each slant roll 62 is located at the separation position and inclined so as to be oriented in the one direction.

Figure 26:
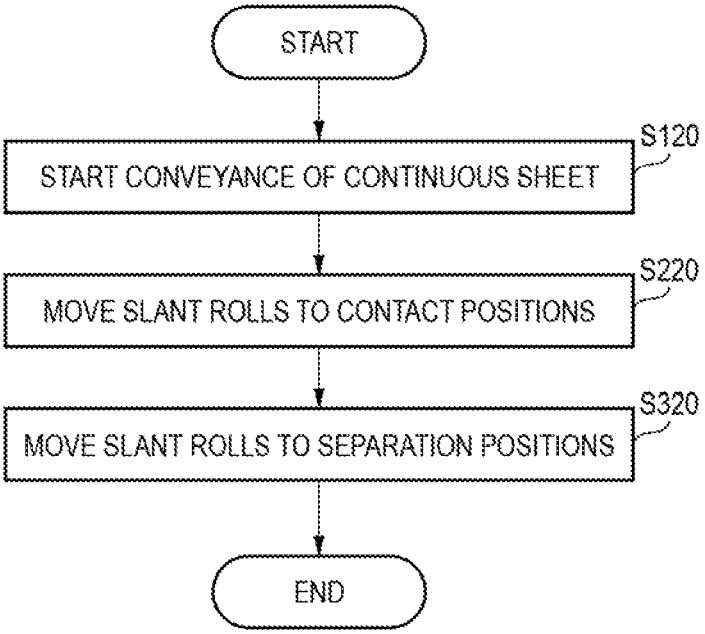
FIG. 26 is a control flowchart for the restricting device of the image forming apparatus according to the fifth exemplary embodiment of the invention.
Figure 27:
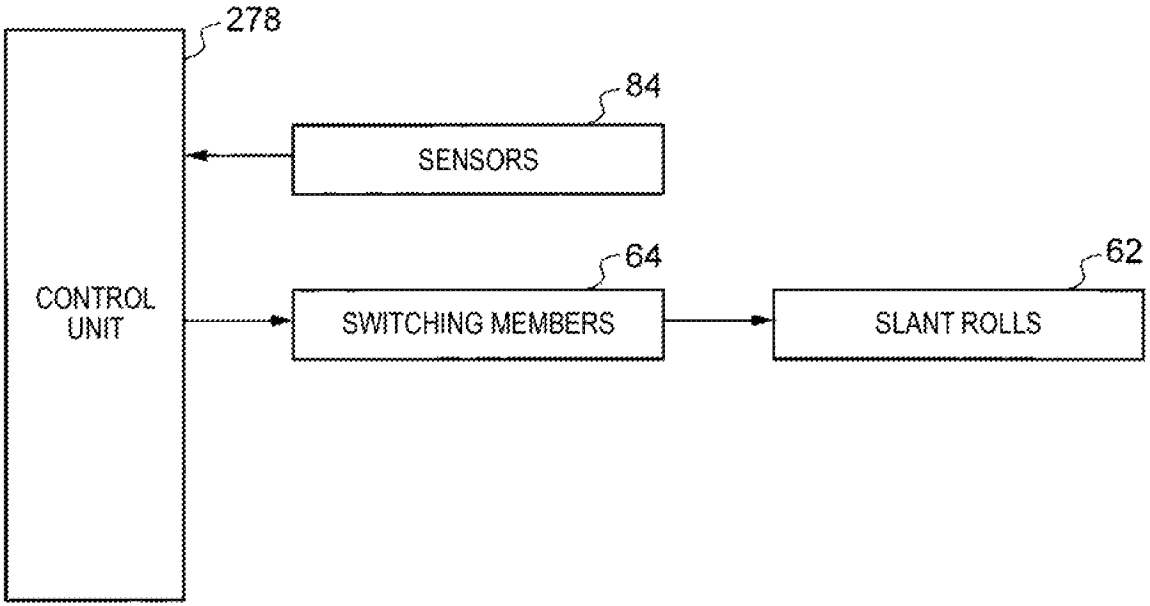
FIG. 27 is a block diagram of a control system of the restricting device of the image forming apparatus according to the fifth exemplary embodiment of the invention.

If the image forming apparatus 250 is put into operation in this state, conveyance of the continuous sheet P is started at step S120 (see FIG. 26). The support rolls 266 that are inclined so as to be oriented in the other direction rotate following the continuous sheet P being conveyed. As a result, a portion, opposed to the droplets ejecting heads 22, of the continuous sheet P is given a force for moving it inward in its width direction.

The portion, opposed to the droplets ejecting heads 22, of the continuous sheet P is moved inward in its width direction and the one edge of that portion of the continuous sheet P comes into contact with the guide plates 82, whereby the guide plates 82 restrict the position of that portion of the continuous sheet P in its width direction. If all the sensors 84 have detected that the one edge of the portion, opposed to the droplets ejecting heads 22, of the continuous sheet P has come into contact with the respective guide plates 82, the process moves to step S220.

At step S220, the control unit 278 controls the switching members 64 to move the restriction rolls 62 from the separation positions to the contact positions.

A portion, opposed to the droplets ejecting heads 22, of the continuous sheet P is sandwiched between the slant rolls 62 located at the contact positions and the support plate 264, and the slant rolls 62 rotate following the continuous sheet P being conveyed. As a result, that portion of the continuous sheet P is given a force for moving it outward in its width direction, whereby that portion of the continuous sheet P is given tension in its width direction.

The droplets ejecting heads 22 of the respective colors eject droplets of the respective colors in order onto the continuous sheet P to form an image thereon. Upon completion of the image forming job, the process moves to step S320.

At step S320, the control unit 278 controls the switching members 64 to move the slant rolls 62 from the contact positions to the separation positions, whereupon the conveyance of the continuous sheet P is stopped and the process is finished.

The other part of the operation of the restricting device 260 of the image forming apparatus 250 according to the fifth exemplary embodiment is the same as that of the restricting device 40 of the image forming apparatus 10 according to the first exemplary embodiment.

Exemplary Embodiment 6

Next, an image forming apparatus 300 according to a sixth exemplary embodiment will be described with reference to FIGS. 28 and 29. As for the image forming apparatus 300, differences from the image forming apparatus 10 according to the first exemplary embodiment will be described mainly.

(Configuration)

Figure 28:
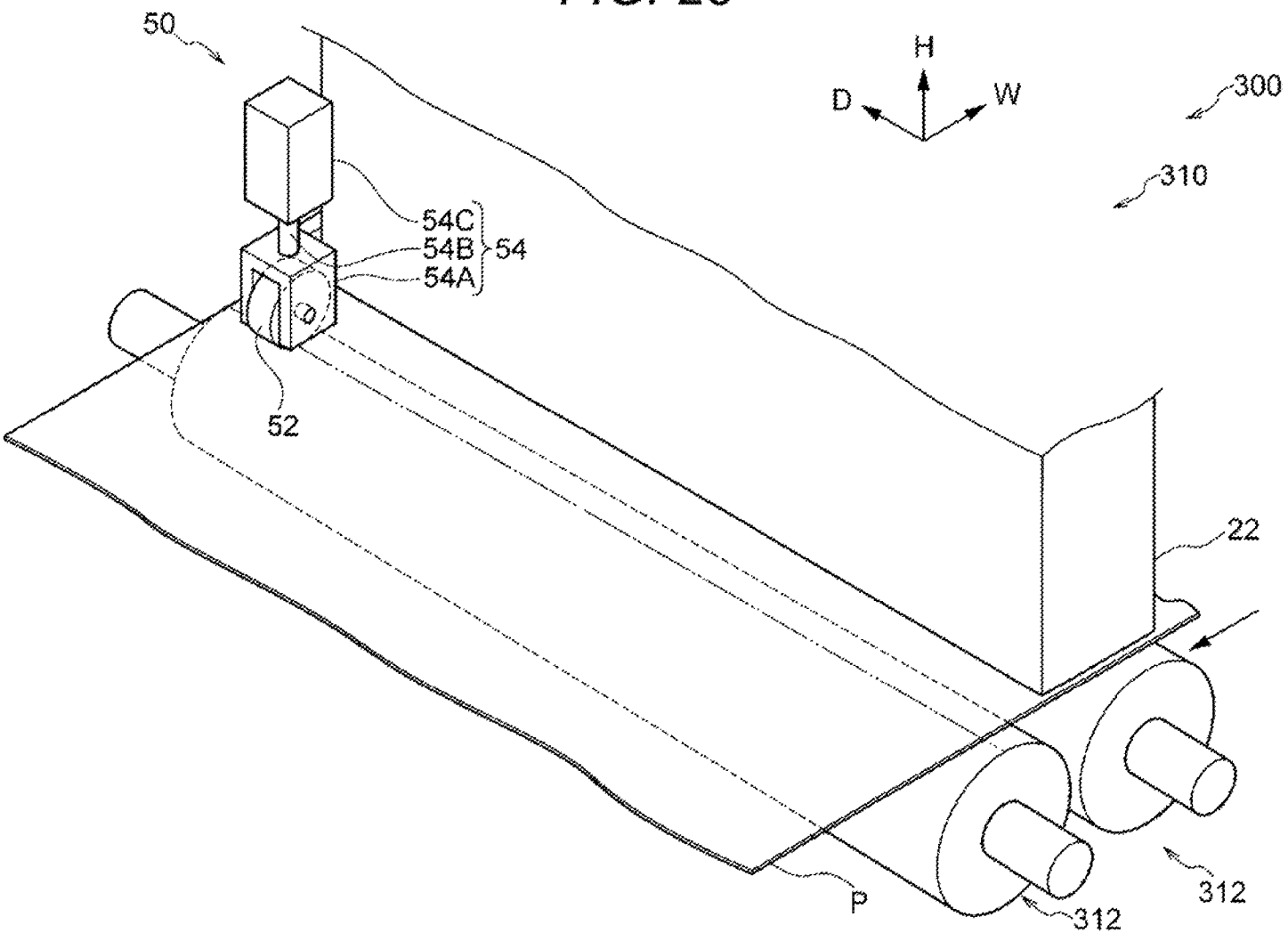
FIG. 28 is a perspective view of a restricting device of an image forming apparatus according to a sixth exemplary embodiment of the invention.
Figure 29:
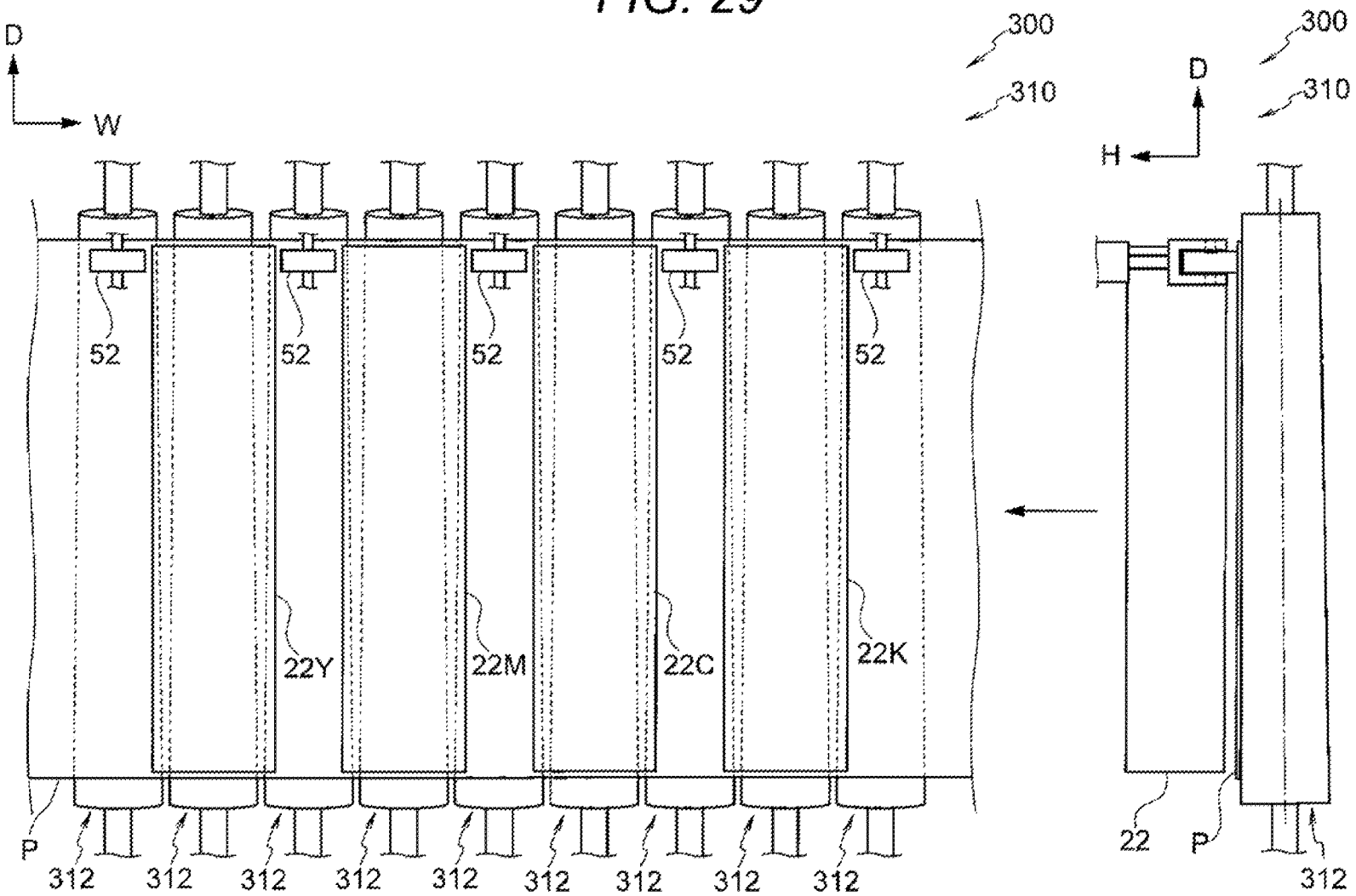
FIG. 29 is a plan view and a side view of the restricting device of the image forming apparatus according to the sixth exemplary embodiment of the invention.

As shown in FIGS. 28 and 29, the restricting device 310 of the image forming apparatus 300 is equipped with neither the tension applying mechanisms 60 nor the guide mechanisms 80. The restricting device 310 is equipped with plural pairs of support rolls 312 which support a portion, opposed to the droplets ejecting heads 22, of the continuous sheet P from its non-image-formation side.

Each pair of support rolls 312 are spaced from each other in the sheet conveying direction. More specifically, one support roll 312 is disposed on the opposite side of a portion, opposed to the droplets ejecting heads 22, of the continuous sheet P to each droplets ejecting head 22 and the other support roll 312 is disposed on the opposite side of that portion of the continuous sheet P to the associated restriction roll 52.

Each support roll 312 is what is called a tapered roll, that is, its portion located on the apparatus front side of the continuous sheet P is larger in diameter than its portion located on the deep side of the continuous sheet P. Furthermore, as shown in the right-hand part of FIG. 29, the axial direction of each support roll 312 is inclined from the width direction of the continuous sheet P when viewed parallel with the sheet conveying direction. With this structure, the support rolls 312 supports a portion, opposed to the droplets ejecting heads 22, of the continuous sheet P fully in its width direction so that the paper surface of the continuous sheet P is set perpendicular to the vertical direction.

(Operation)

Next, how the restricting device 310 operates will be described.

The restriction rolls 52 are located at the movement restriction positions, and a portion, opposed to the droplets ejecting heads 22, of the continuous sheet P is sandwiched between the restriction rolls 52 and the support rolls 312.

The restriction rolls 52 and the support rolls 312 rotate following the continuous sheet P being conveyed. Since a portion, opposed to the droplets ejecting heads 22, of the continuous sheet P is sandwiched between the restriction rolls 52 and the support rolls 312, movement, in the width direction of the continuous sheet P, of portions, located on the deep side in the width direction of the continuous sheet P, of the continuous sheet P is restricted.

Since the circumferential speed of each support roll 312 becomes higher as its diameter increases, the continuous sheet P is attracted to the large-diameter side, that is, to the apparatus front side, and is thereby given tension.

The other part, of the operation of the restricting device 310 of the image forming apparatus 300 according to the sixth exemplary embodiment is the same as that of the restricting device 40 of the image forming apparatus 10 according to the first exemplary embodiment.

Exemplary Embodiment 7

Figure 30:
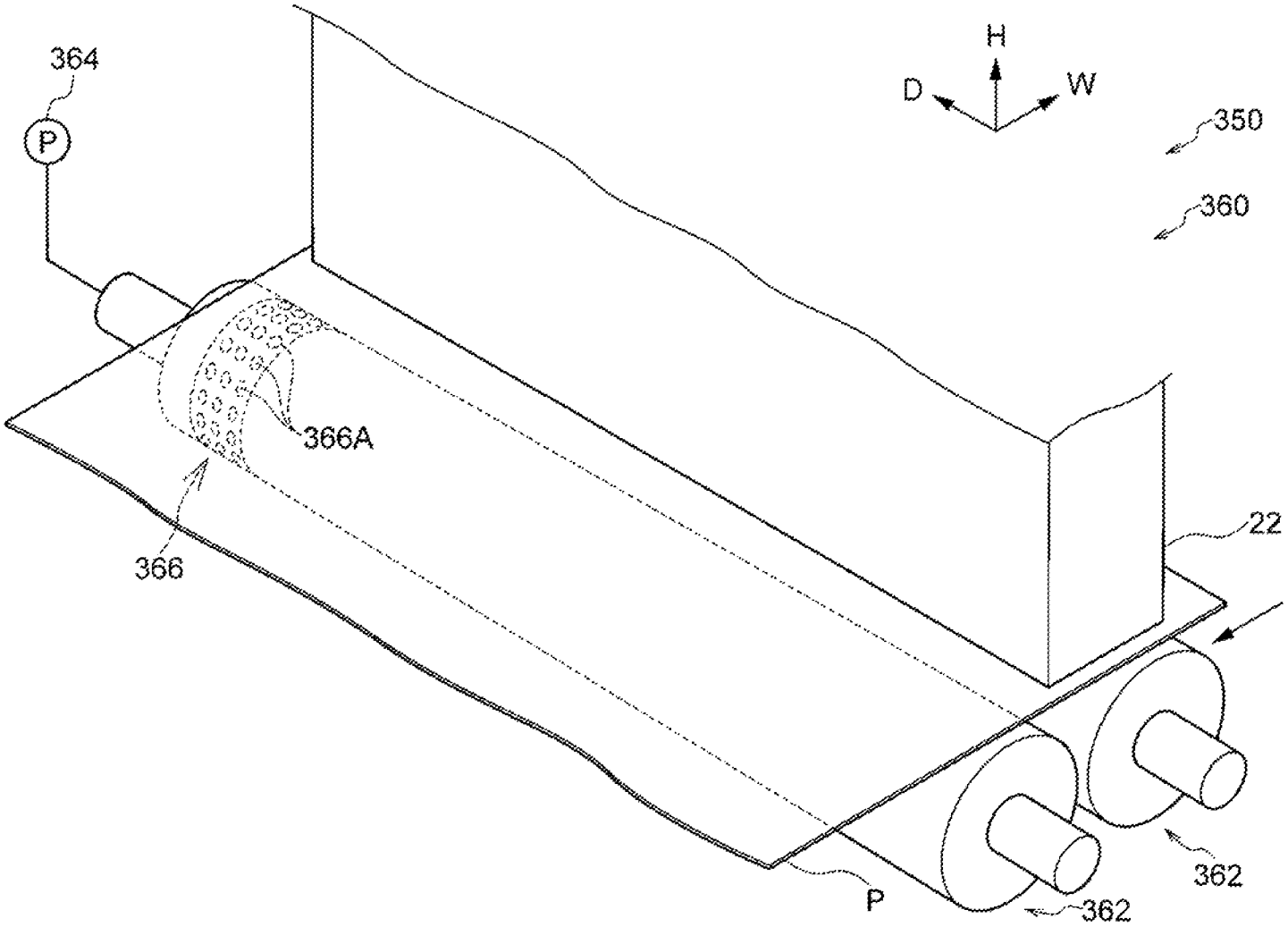
FIG. 30 is a perspective view of a restricting device of an image forming apparatus according to a seventh exemplary embodiment of the invention.
Figure 31:
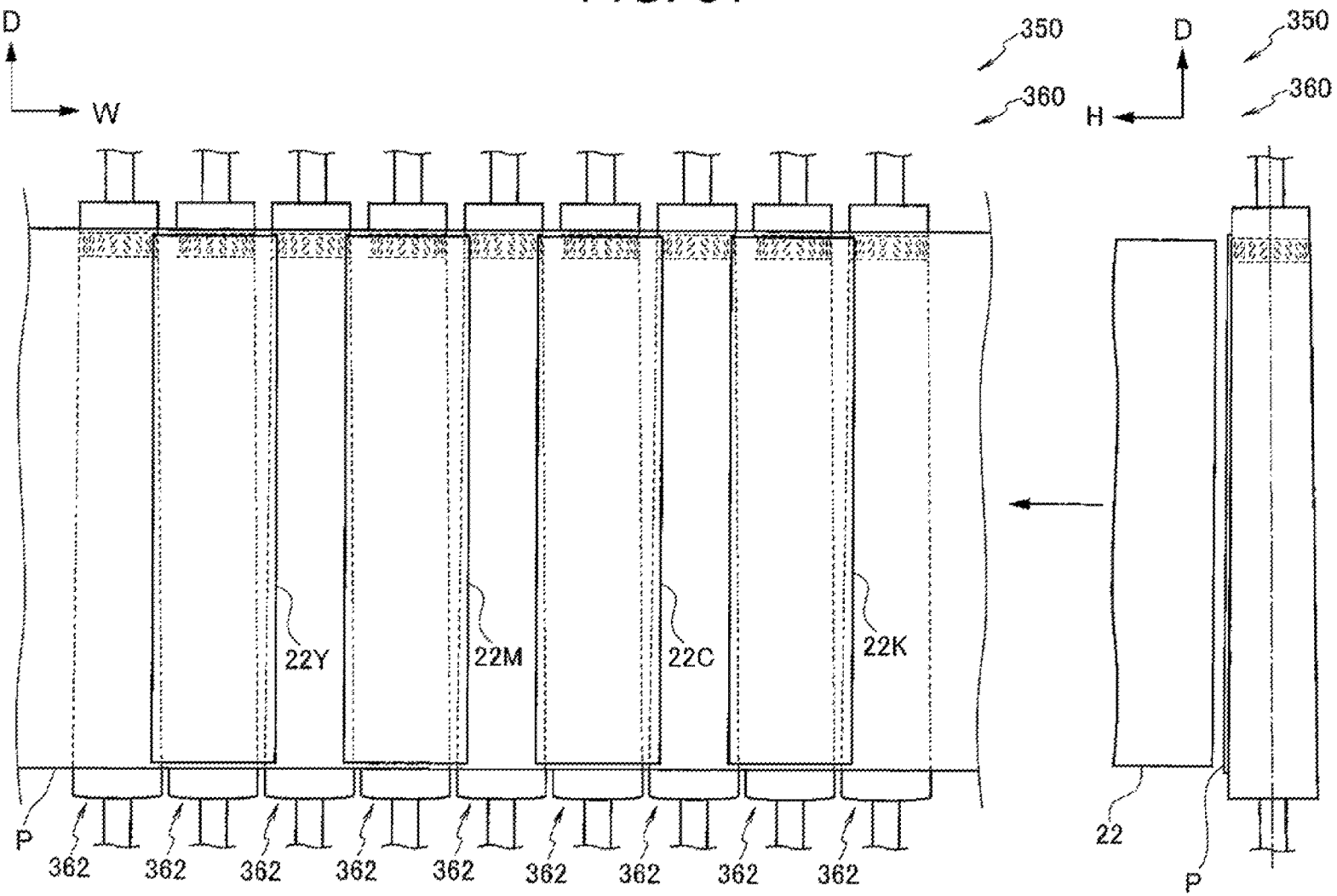
FIG. 31 is a plan view and a side view of the restricting device of the image forming apparatus according to the seventh exemplary embodiment of the invention.

Next, an image forming apparatus 350 according to a seventh exemplary embodiment will be described with reference to FIGS. 30 and 31. As for the image forming apparatus 350, differences from the image forming apparatus 300 according to the sixth exemplary embodiment will be described mainly.

(Configuration)

A restricting device 360 of the image forming apparatus 350 is not equipped with the movement restricting mechanisms 50. As shown in FIGS. 30 and 31, the restricting device 360 is equipped with a suction pump 364 which is an example first switching device and plural pairs of support rolls 362 which are example rotary members.

Each support roll 362 is a hollow roll, and a portion, located on the deep side in the width direction of the continuous sheet P, of the support roll 362 is formed with a circumferential absorption region 366 which is an example movement restriction member. The absorption region 366 is formed with plural suction openings 366A. When the suction pump 364 operates, air is sucked through the suction openings 366A, whereby a portion, located on the deep side in the width direction of the continuous sheet P, of the continuous sheet p is absorbed on the absorption region 366.

The other part of the operation of the restricting device 360 of the image forming apparatus 350 according to the seventh exemplary embodiment is the same as that of the restricting device 310 of the image forming apparatus 300 according to the sixth exemplary embodiment except that movement of a portion, opposed to the droplets ejecting heads 22, of the continuous sheet P is restricted by the absorption regions 366.

Exemplary Embodiment 8

Next, an image forming apparatus 400 according to an eighth exemplary embodiment will be described with reference to FIGS. 32 and 33. As for the image forming apparatus 400, differences from the image forming apparatus 300 according to the sixth exemplary embodiment will be described mainly.

(Configuration)

Figure 32:
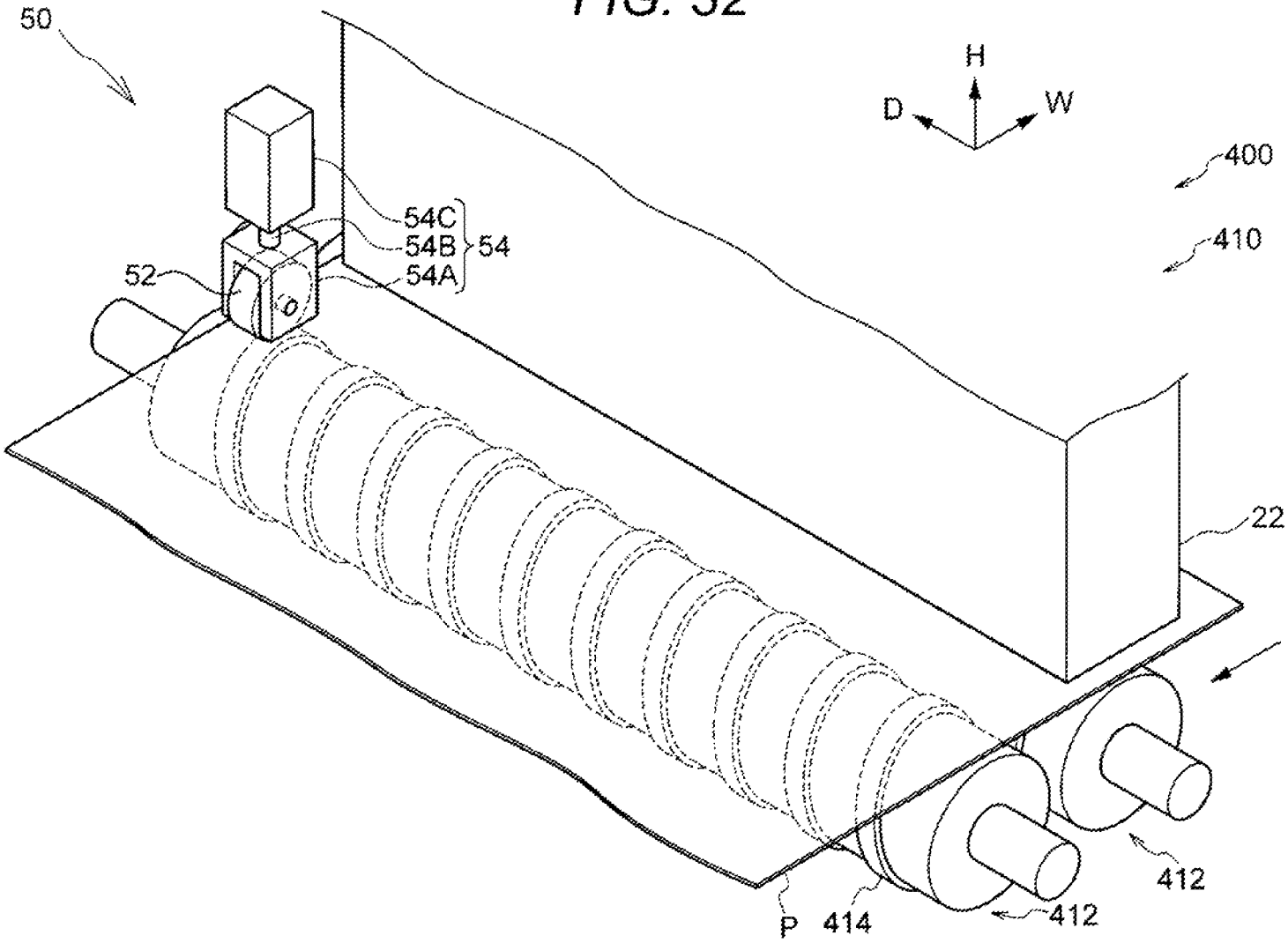
FIG. 32 is a perspective view of a restricting device of an image forming apparatus according to an eighth exemplary embodiment of the invention.
Figure 33:
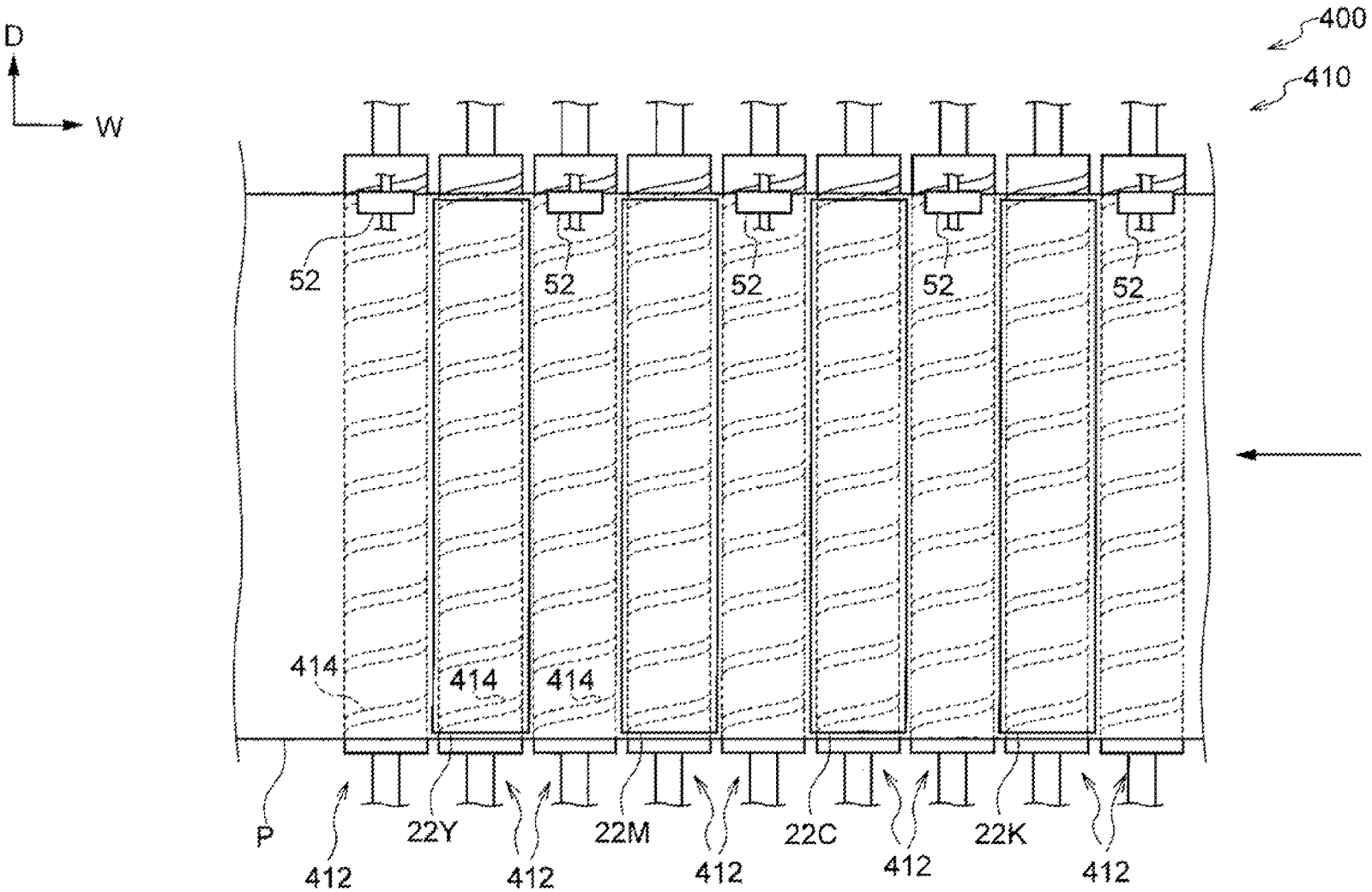
FIG. 33 is a plan view of the restricting device of the image forming apparatus according to the eighth exemplary embodiment of the invention.

As shown in FIGS. 32 and 33, the restricting device 410 of the image forming apparatus 400 is not equipped with the tapered support rolls 312. The restricting device 410 is equipped with plural pairs of support rolls 412 which support a portion, opposed to the droplets ejecting heads 22, of the continuous sheet P from its non-image-formation side.

Each pair of support rolls 312 which are a pair of example rotary members are spaced from each other in the sheet conveying direction. More specifically, one support roll 412 is disposed on the opposite side of a portion, opposed to the droplets ejecting heads 22, of the continuous sheet P to each droplets ejecting head 22 and the other support roll 412 is disposed on the opposite side of that portion of the continuous sheet P to the associated restriction roll 52. The outer circumferential surface of each support roll 412 is formed with a spiral projection 414.

In the above structure, the support rolls 412 rotate following the continuous sheet P being conveyed. A portion, opposed to the droplets ejecting heads 22, of the continuous sheet P is given tension by frictional forces produced between the projection 414 and the continuous sheet P.

The other part of the operation of the restricting device 410 of the image forming apparatus 400 according to the eighth exemplary embodiment is the same as that of the restricting device 310 of the image forming apparatus 300 according to the sixth exemplary embodiment.

Although the exemplary embodiments of the invention have been described above in detail, the invention is not limited to those exemplary embodiments. It is apparent to those skilled in the art that various other embodiments are possible within the scope of the invention. For example, although not described in the above exemplary embodiments, a configuration is possible; in which movement of a portion, located on the apparatus front side in the width direction of the continuous sheet P, of the continuous sheet P is restricted and a portion, located on the deep side in the width direction of the continuous sheet P, of the continuous sheet P is pulled outward in its width direction.

Although the above exemplary embodiments are directed to the case that plural colors are used, the invention can also be applied to a case that plural droplets ejecting heads eject droplets of the same color.

The foregoing description of the embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention defined by the following claims and their equivalents.

What is claimed is:

1. An image forming apparatus comprising:

a plurality of droplets ejecting members that are opposed to a continuous sheet being conveyed, are arranged in a sheet conveying direction, and eject droplets onto the continuous sheet;

movement restriction members that are provided so as to move between a position at which the movement restriction members contact with the continuous sheet and a position at which the movement restriction members are separated from the continuous sheet, wherein, in a case that the movement restriction members are at the position at which the movement restriction members contact with the continuous sheet, the movement restriction members restrict movement, in a sheet width direction, of one end portion, in the sheet width direction, of a portion, opposed to the droplets ejecting members, of the continuous sheet;

tension application members that are slant members that give tension in the sheet width direction to the portion, opposed to the droplets ejecting members, of the continuous sheet in a state that movement, in the sheet width direction, of the portion, opposed to the droplets ejecting members, of the continuous sheet is restricted by the movement restriction members, by rotating following the continuous sheet being conveyed in a state that the tension application members are in contact with other end portion of the portion, opposed to the droplets ejecting members, of the continuous sheet and are inclined so as to be directed in one direction relative to the sheet conveying direction;

restriction members that come into contact with one edge of the portion, opposed to the droplets ejecting members, of the continuous sheet and thereby restrict a position of the portion, opposed to the droplets ejecting members, of the continuous sheet in the sheet width direction;

said restriction members are guide plates having a sheet-contact surface that is perpendicular to the width direction of the sheet;

a first switching device or members that switch between a movement restriction state of restricting movement in the sheet width direction of the portion, opposed to the droplets ejecting members, of the continuous sheet and a movement permission state of allowing the portion, opposed to the droplets ejecting members, of the continuous sheet to move in the sheet width direction by switching the movement restriction members;

second switching members that switch the direction of the slant members between one direction for application of the tension to the portion, opposed to the droplets ejecting members, of the continuous sheet and other direction for bringing the one edge of the portion, opposed to the droplets ejecting members, of the continuous sheet to the restriction members; and a control unit that gives the tension to the portion, opposed to the droplets ejecting members, of the continuous sheet by bringing the one edge of the portion, opposed to the droplets ejecting members, of the continuous sheet into contact with the restriction members after controlling the second switching members to incline the slant members so that the slant members are directed in the other direction when the movement restriction members are in the movement permission state and controlling the first switching device or members to switch the movement restriction members from the movement permission state to the movement restriction state and by controlling the second switching members to incline the slant members so that the slant members are directed in the one direction.

* * * * *